US005687829A

United States Patent [19]

Churchman

[11] Patent Number: 5,687,829

[45] Date of Patent: Nov. 18, 1997

[54] COIN VALIDATORS

[75] Inventor: James Churchman, Llysworney, Great Britain

[73] Assignee: Tetrel Limited, United Kingdom

[21] Appl. No.: 780,217

[22] Filed: Jan. 8, 1997

Related U.S. Application Data

[63] Continuation of Ser. No. 416,785, Apr. 14, 1995, abandoned.

[30] Foreign Application Priority Data

Oct. 14, 1992 [GB] United Kingdom ..... 9221591
Jul. 13, 1993 [GB] United Kingdom ..... 9314508

[51] Int. Cl.[6] ..... G07D 5/08

[52] U.S. Cl. ..... 194/317; 324/674

[58] Field of Search ..... 194/317; 324/660, 324/661, 662, 663, 671, 674

[56] References Cited

U.S. PATENT DOCUMENTS

| | | | |
|---|---|---|---|
| 3,169,626 | 2/1965 | Miyagawa et al. | 194/317 |
| 4,089,400 | 5/1978 | Gregory | 194/331 X |
| 4,951,800 | 8/1990 | Yoshihara | 194/317 |

FOREIGN PATENT DOCUMENTS

| | | |
|---|---|---|
| 164110 | 12/1985 | European Pat. Off. . |
| 349114 | 1/1990 | European Pat. Off. . |
| 384374 | 8/1990 | European Pat. Off. . |
| 2353911 | 6/1976 | France . |
| 486078 | 2/1970 | Switzerland . |
| 994736 | 11/1963 | United Kingdom . |
| 2045498 | 10/1980 | United Kingdom . |
| 2062327 | 5/1981 | United Kingdom . |
| 8303154 | 9/1983 | WIPO . |

*Primary Examiner*—F. J. Bartuska
*Attorney, Agent, or Firm*—Lerner, David, Littenberg, Krumholz & Mentlik

[57] ABSTRACT

In a coin detection system, a coin passes between conductive plates which form a capacitor, which provides part of the frequency controlling capacitance of an LC tuned oscillator circuit. The presence of a coin between the conductive plates alters the capacitance, and consequently alters the output frequency of the oscillator circuit. The oscillator output is supplied to the clock of a counter, optionally following frequency division in a frequency divider. The counter counts the number of clock pulses received in a 10 ms period, and the count value is provided to a microprocessor via a shift register. The count value will be a measure of the frequency of the output of the oscillator. The microprocessor uses the output to determine whether a valid coin has been received, and if so, what the denomination of the valid coin is.

54 Claims, 11 Drawing Sheets

FIG. 5a
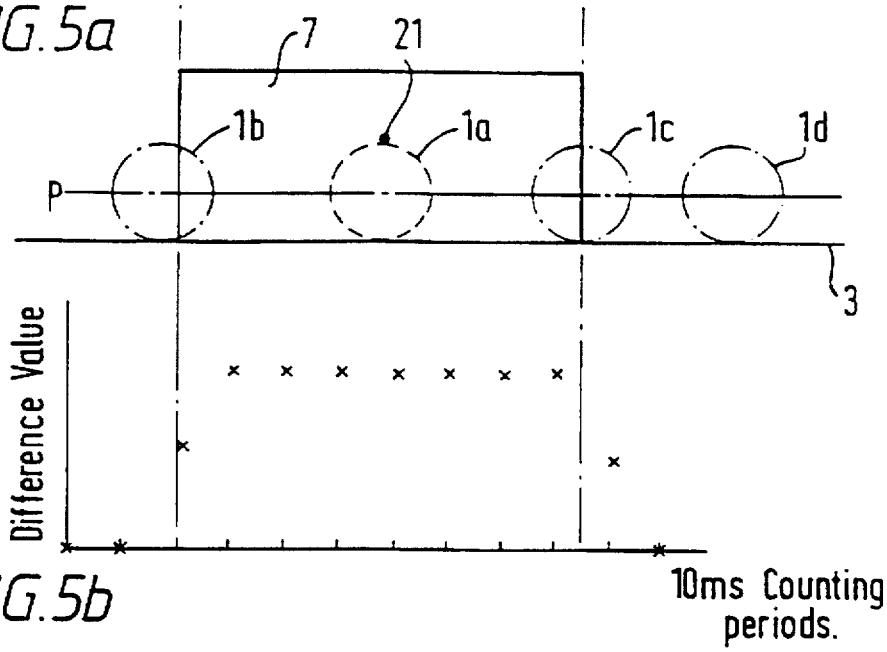
FIG. 5b
FIG. 6.
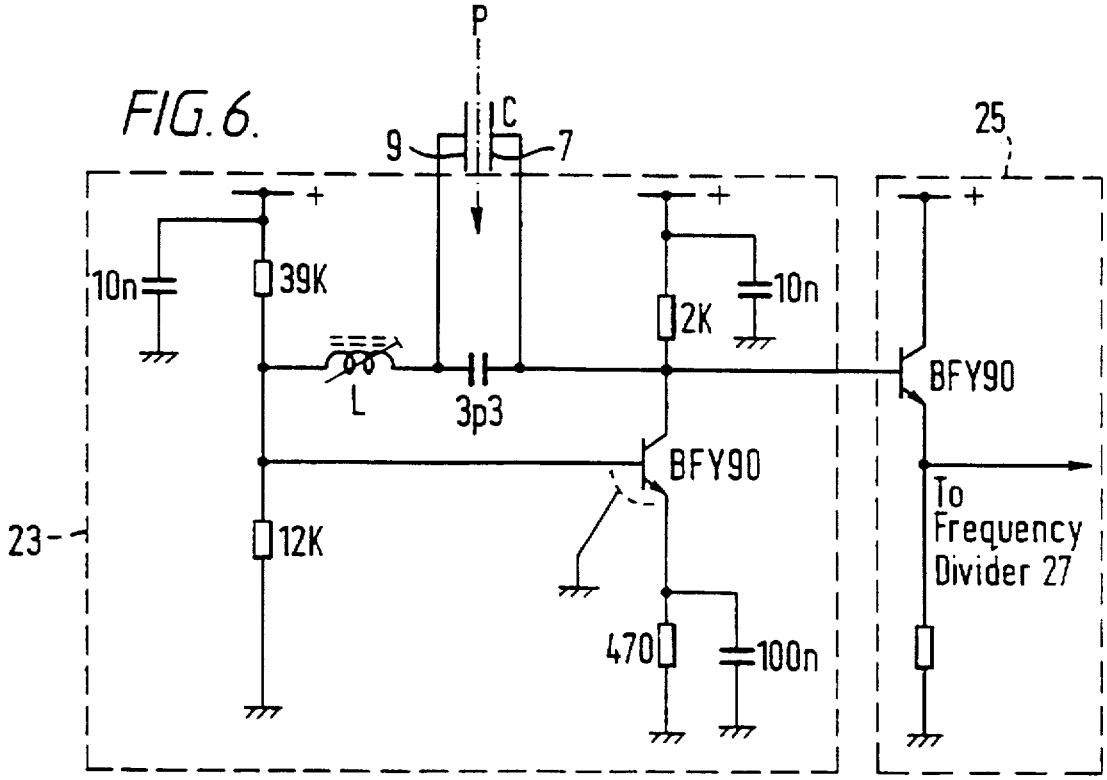

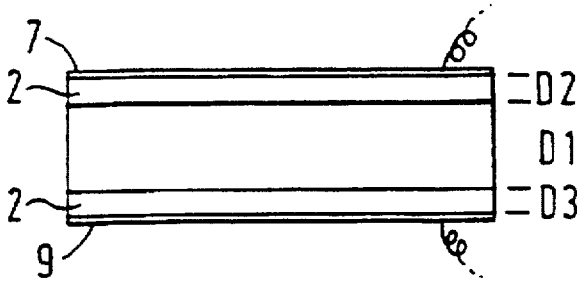
FIG. 8
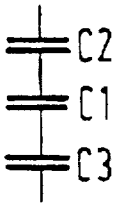
FIG. 9
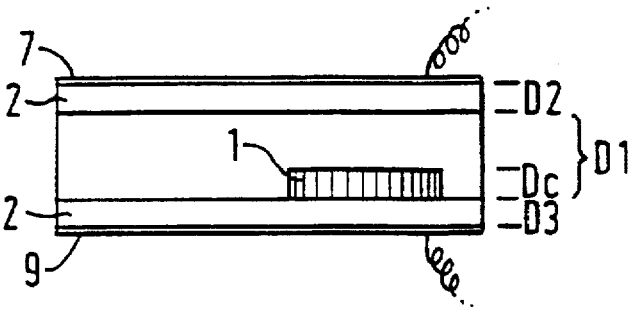
FIG. 10
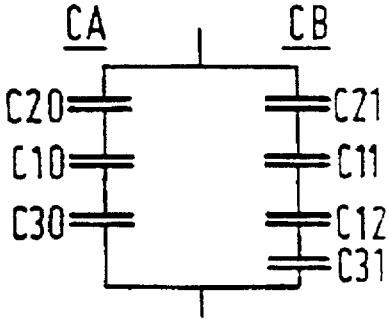
FIG. 11
FIG. 12a
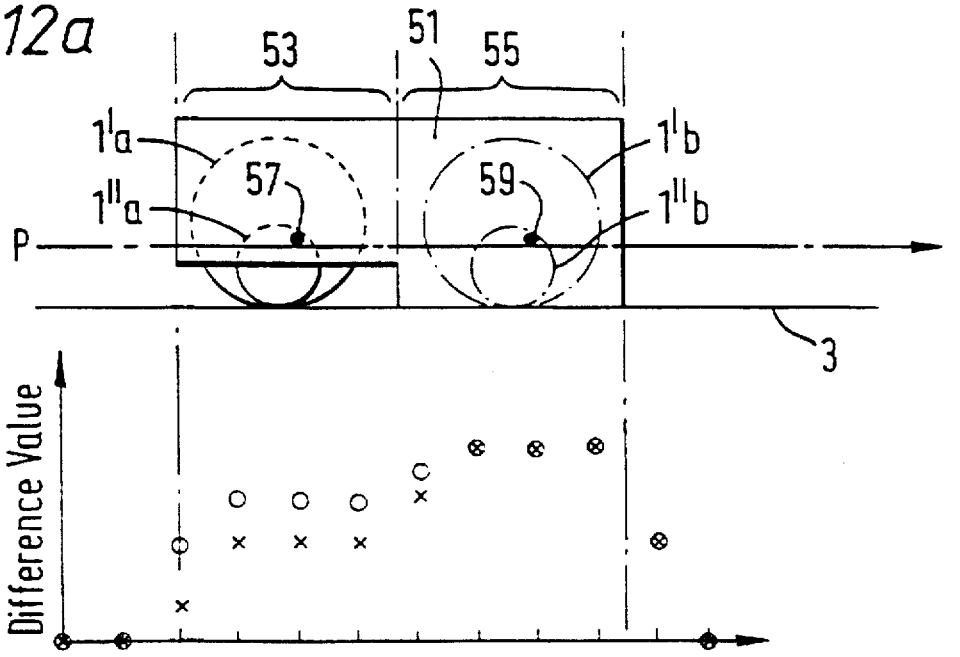
FIG. 12b FIG. 13a
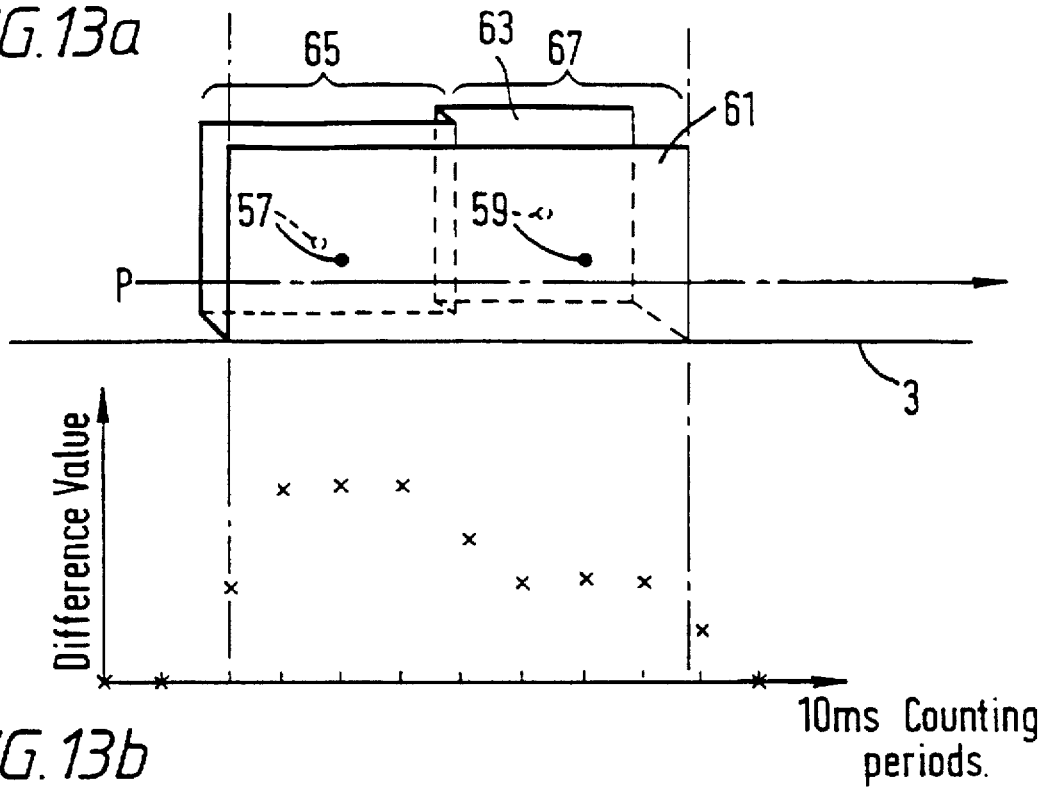
FIG. 13b
FIG. 14a
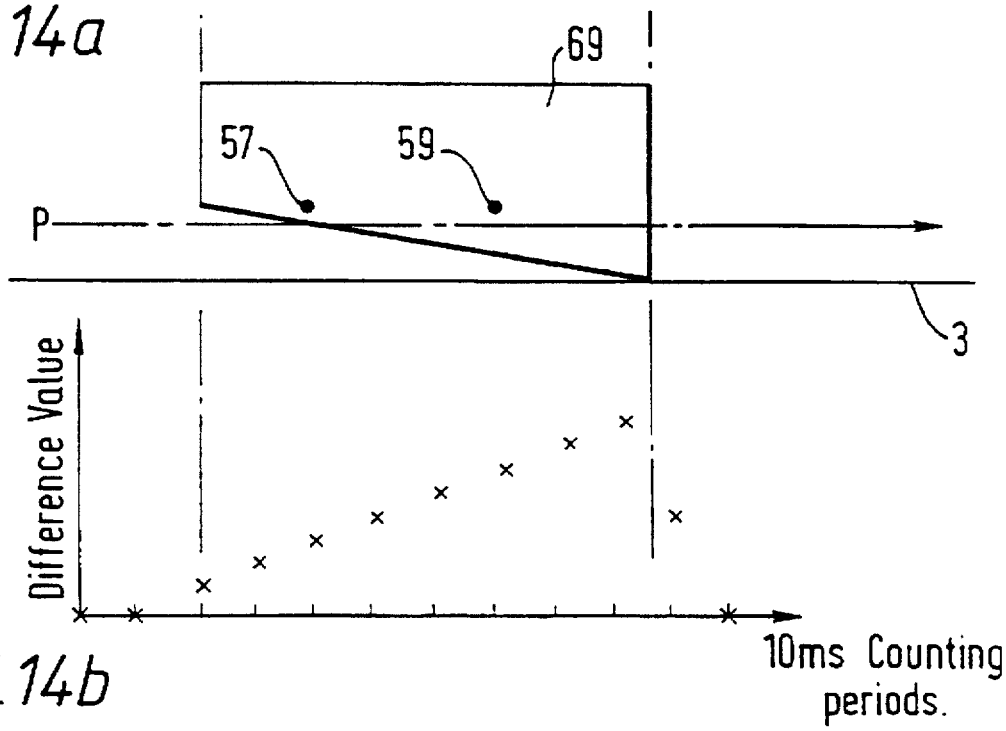
FIG. 14b

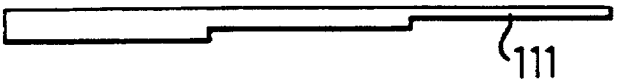
FIG. 29
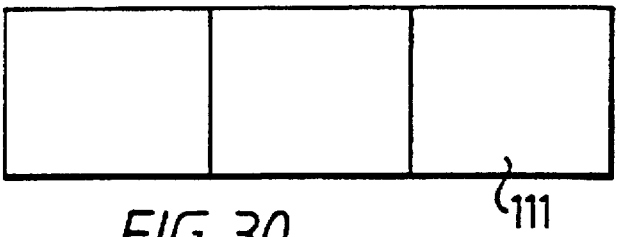
FIG. 30
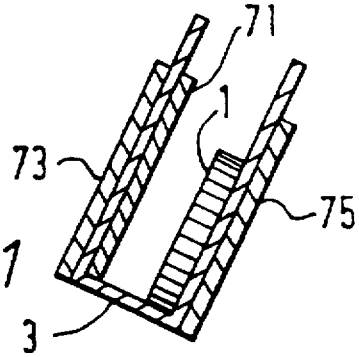
FIG. 31
FIG. 32a
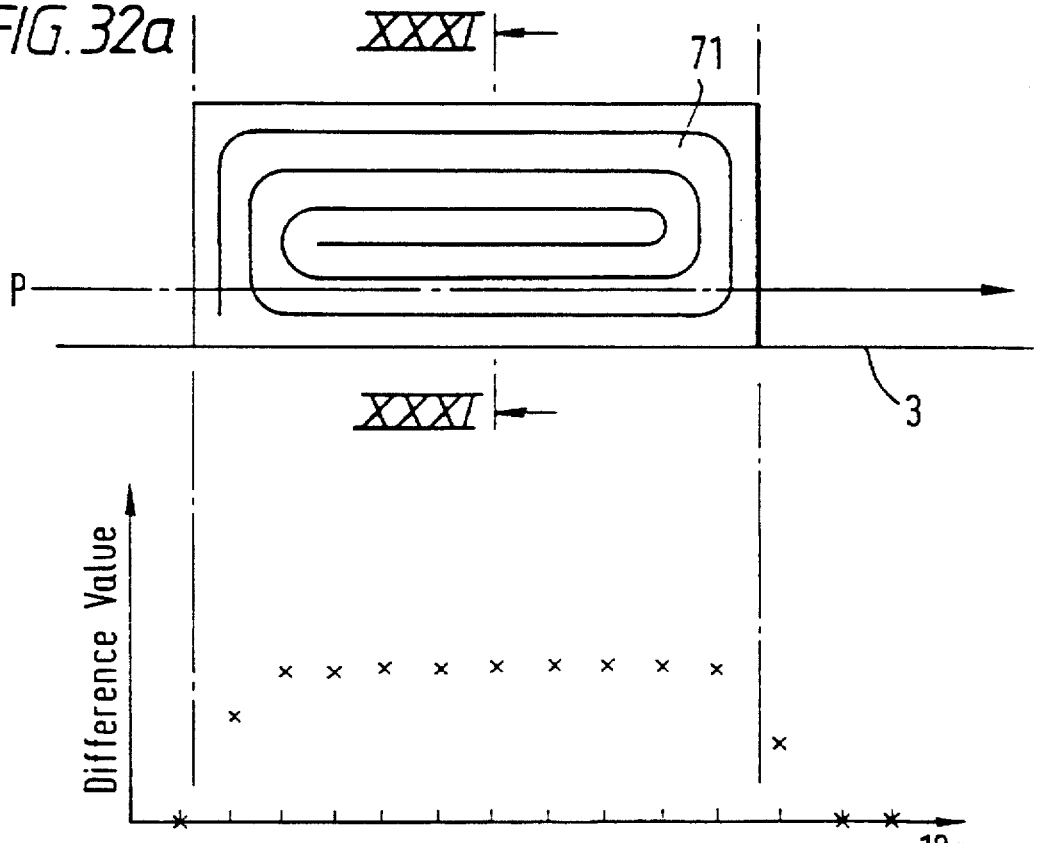
FIG. 32b L1
C
P
+
+
10n
39K
2K
10n
L2
3p3
To Buffer 25
BFY 90
12K
23
470
100n

COIN VALIDATORS

This is a continuation, of application Ser. No. 08/416,785, filed Apr. 14, 1995 now abandoned.

This invention relates to coin validators such as for use in pay telephones or vending machines.

It should be understood that the word "coin" as used herein is not limited to money in general circulation, but may cover a token or slug of any form regardless of whether it has any monetary value and the term "coin validation" is intended to cover the validation such of tokens or slugs.

There have been proposed, e.g. in GB-A-2062327 and U.S. Pat. No. 4184366, systems for detecting whether a coin exceeds a threshold diameter, by providing a first capacitor plate spaced from a second capacitor plate. As a coin passes along a coin chute, it will overlap both capacitor plates at the same time, thereby coupling a signal from one plate to the other, if the coin is large enough to bridge the space between the plates. Therefore the presence or absence of the signal indicates whether the coin exceeds the threshold diameter. Such a system cannot measure the coin diameter, but merely decides whether it exceeds the threshold. U.S. Pat. No. 4184366 provides a plurality of second capacitor plates to provide a plurality of diameter thresholds.

GB-A-1464371 and WO 86/06246 propose a capacitor the capacitance of which is altered by a passing coin. In GB-A-1464371 a signal at a preset frequency is applied to the capacitor and the amplitude of the current flow through the capacitor is detected. In WO 86/06246 the capacitor is provided in an RC circuit to which a signal at a preset frequency is applied, and the amplitude of the current in the RC circuit is detected. In each case, the amplitude is a measure of a property of the coin, and accordingly it can be applied to threshold detectors to determine whether the property of the coin exceeds corresponding thresholds. GB-A-2174227 proposes a system in which a voltage change is caused by a coin passing between capacitor plates and the size of the change is digitised and supplied to a microprocessor.

GB-A-994736 proposes a system in which a coin alters the capacitance of a capacitor in a resonant circuit, thereby altering the Q value of the resonant circuit. The resonant circuit is provided in an oscillator feedback loop so that the oscillator either will or will not oscillate depending on the Q value. Accordingly, the presence or absence of an oscillator output while a coin is present provides a threshold detection of a property of the coin.

GB-A-2174227 and U.S. Pat. No. 4184366, referred to above, also both propose that the coin is used to affect the inductance of a coil. In GB-A-2174227, the inductance change is detected by detecting the change in resonant amplitude of a resonant circuit comprising the coil, as described in GB-A-2169429. In U.S. Pat. No. 4,184,336, the inductance change is detected by detecting the change in the frequency of an oscillator controlled by a tuned circuit comprising the coil.

FR-A-2353911 proposes an arrangement in which coins drop in free fall between the plates of a capacitor. The capacitor is part of a tuned circuit for an oscillator, tuned to 1 MHz when idle. The presence of a coin increases the capacitance of the capacitor and therefore reduces the frequency of the oscillator by 100 to 200 kHz. The frequency change depends on both the thickness and the diameter of the coin. The frequency is measured. A read-only memory stores thresholds for sorting and validating coins. One of the bits of the read-only memory serves to keep the oscillation at a fixed value in the absence of a coin.

In one aspect, the present invention provides a system in which a coin affects a capacitance so as to alter the frequency of an oscillator, and the altered oscillator frequency and a further value are both used to determine which of a plurality of acceptable coins has been input. The further value may be either (i) the altered oscillator frequency when the coin is affecting the capacitance differently because the physical parameters determining the interaction of the coin and the capacitance are different at different points on the coin path, or (ii) a value representing a coin parameter other than its effect on the capacitance.

In another aspect, the invention provides a coin validation system comprising a detection circuit including a coin sensor and a guide means arranged to guide a coin to be validated between conductive plates to cause a change in the frequency of a signal in the detection circuit which change is indicative of the denomination and validity of the coin, the detection circuit also obtaining a further signal, representing either a further change in the frequency of the signal in the detection circuit or representing a different effect of the coin.

The effect of the coin on the capacitance depends on its thickness and its area, and also its permittivity in the case of a non-conductive coin. Therefore different coins can have the same effect on a capacitance so that a single capacitance measurement cannot distinguish them. If the parameters of the capacitance are altered, confusable coins will normally become distinguishable. Alternatively, another effect or feature of the coin, such as its effect on an inductance or its diameter, can be used to distinguish confusable coins. In this way, the further value or signal assists in distinguishing between coins which are con.usable on the basis of a single change in frequency.

In another aspect of the present invention, an input coin is arranged to affect a capacitance so as to alter an oscillation frequency, a detection circuit uses the value of the altered frequency as a measure of coin identity, and a compensation arrangement compensates the operation of the detection circuit for changes over time in the value of the oscillation frequency in the absence of a coin.

According to a further aspect of the present invention, a coin testing or validating arrangement comprises a coin guide for guiding on input coin between walls past conductive plates to alter the capacitance provided by the conductive plates, and means for detecting the alteration in the capacitance caused by the coin, the coin guide having a dielectric member fixed to one of the walls.

The dielectric member allows a single coin guide to be manufactured for use with a variety of coin sets, and the coin guide to be adapted for use with a particular coin set by choosing a dielectric member having a thickness chosen with reference to the thickest coin of the coin set. Additionally, if it is desired to provide different regions of the conductive plates with different capacitive properties, this can be done by altering the dielectric effect of the coin guide in these regions. To achieve this result, an appropriately designed dielectric member, e.g. with variable height, thickness or composition, can be fitted to the coin guide.

In another aspect of the present invention, coin validating apparatus guides a coin past a capacitor means to affect the capacitance thereof, and past an inductor means to affect the inductance thereof, an oscillator circuit outputs a signal the frequency of which is affected by both the capacitance of the capacitor means and the inductance of the inductor means, and the frequency of the output of the oscillator circuit is used to reject or identify the coin.

The inductor means is not necessariy highly sensitive to the size of the coin, but will respond to the magnetic properties of the material of the coin. In this way, it can distinguish between ferromagnetic coins and paramagnetic coins having the same effect on the capacitor means.

Embodiments of the invention, given by way of non-limiting example, will now be described with reference to the accompanying drawings, in which.

Figure 1:
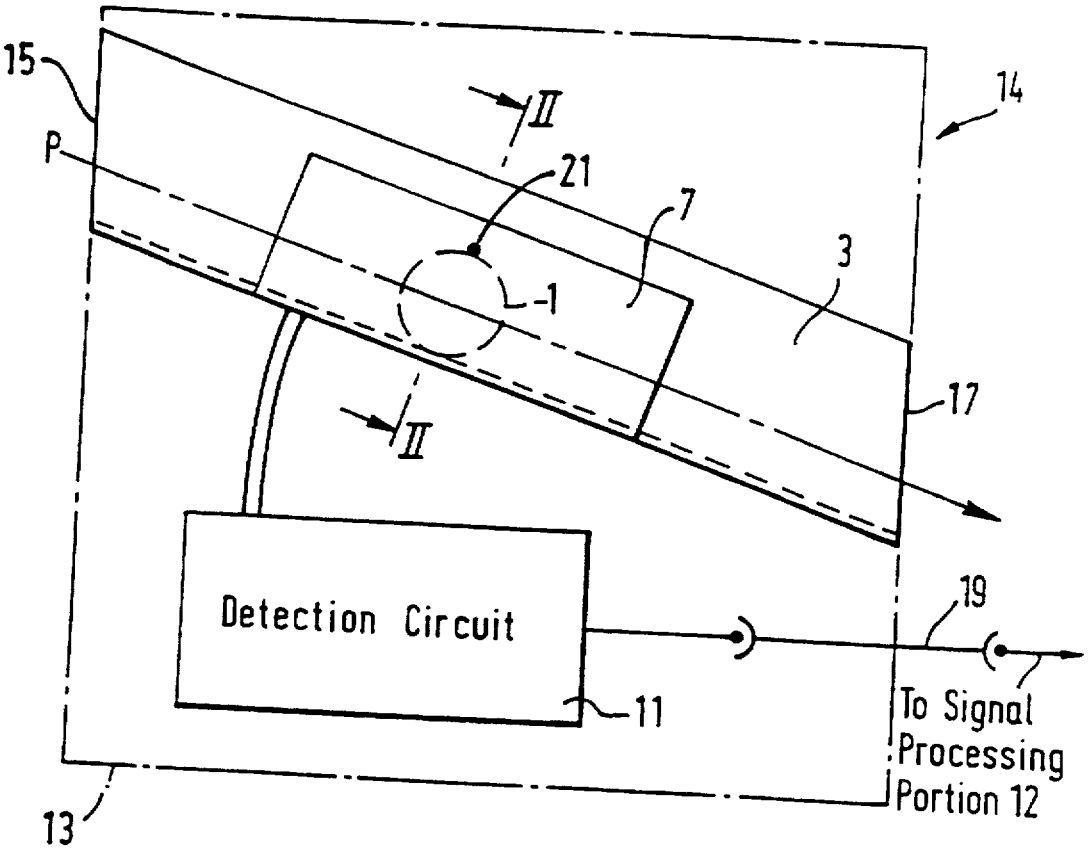
FIG. 1 is a side view of the coin sensing portion of a coin validation system according to an embodiment of the invention.
Figures 3, 4:
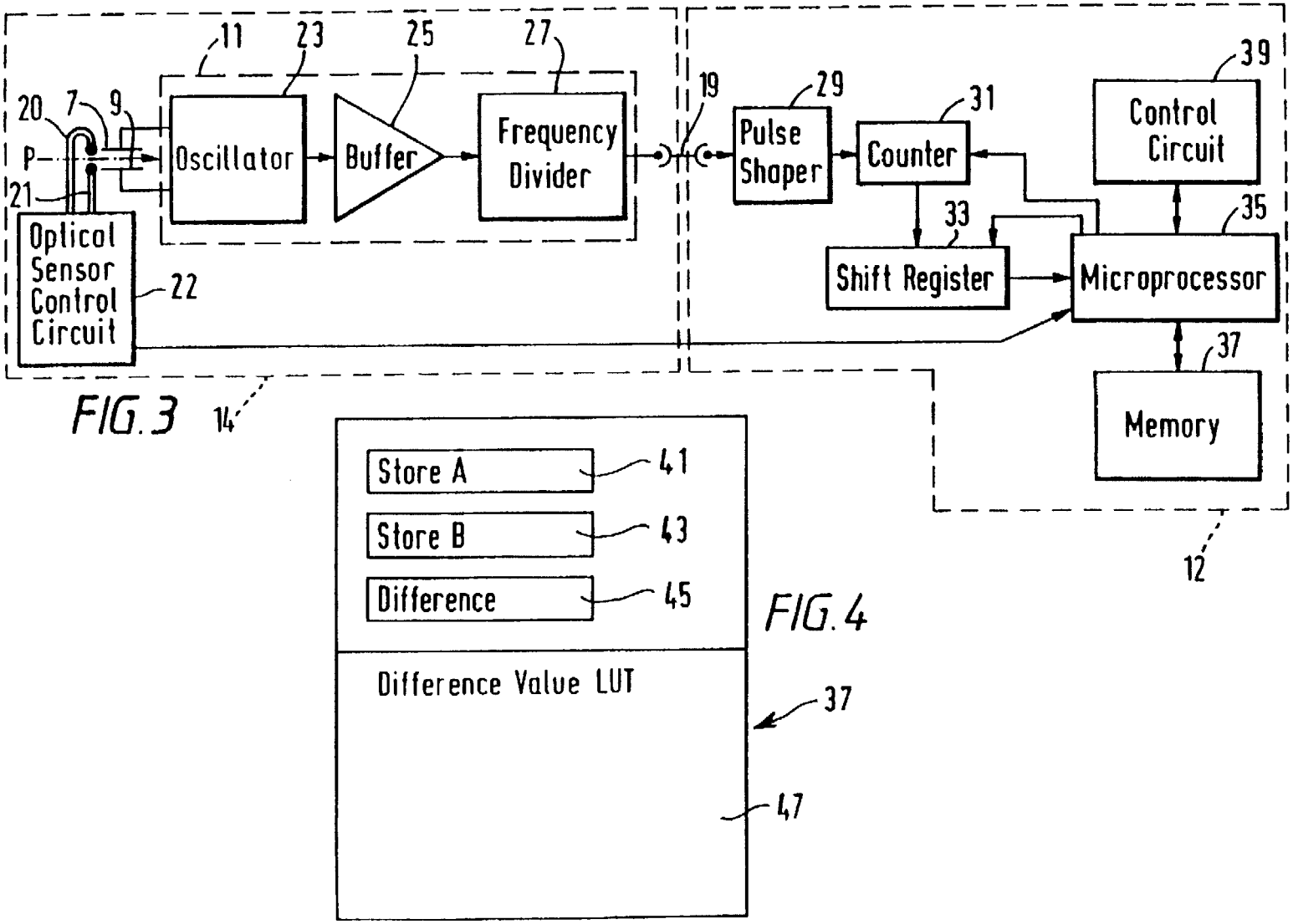
FIG. 3 is an electrical block diagram of the coin validator of FIG. 1 and FIG. 2.
FIG. 4 is a schematic diagram of a memory in the circuit of FIG. 3.
Figure 7:
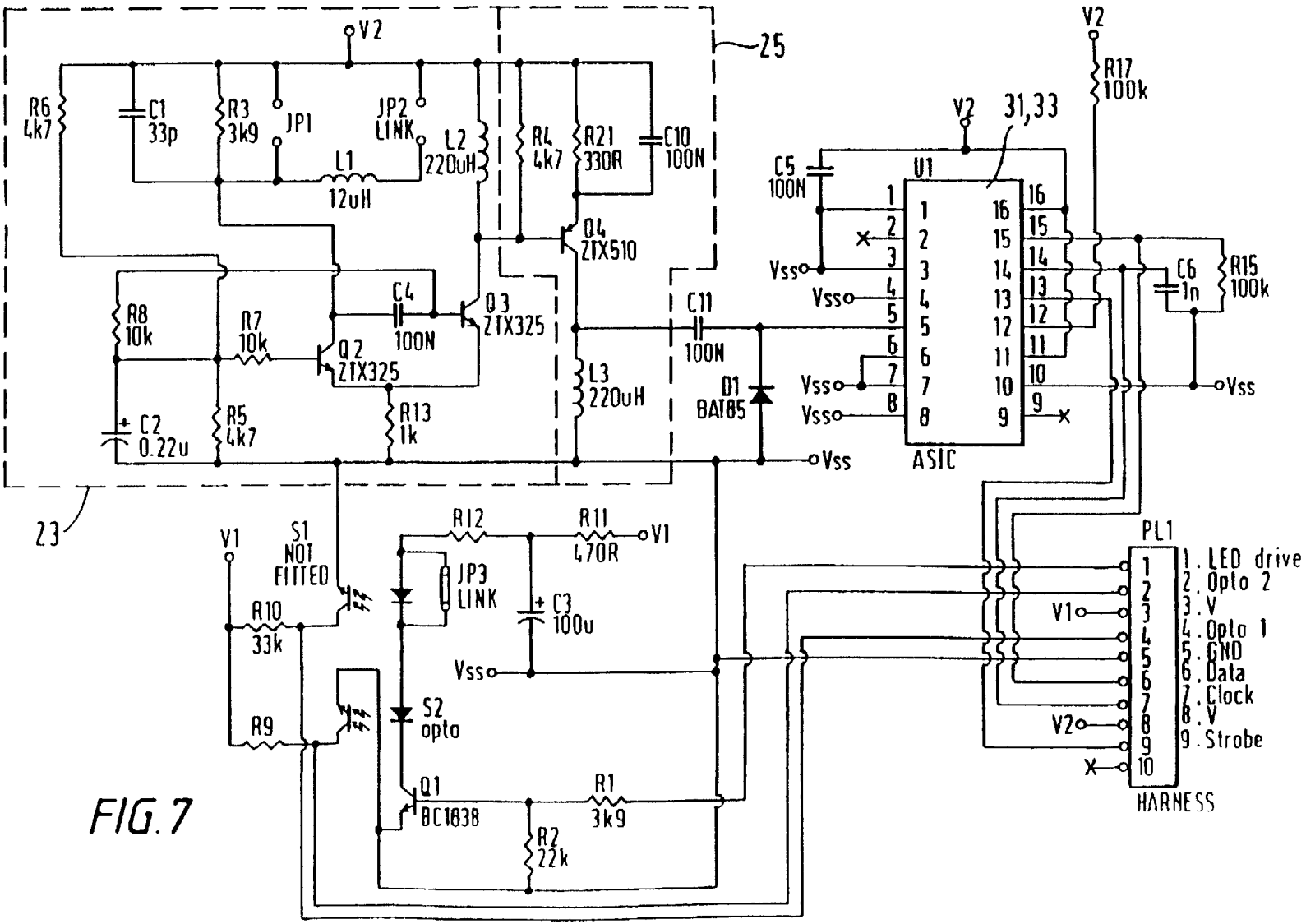

FIG. 5*a* is a diagram illustrating a coin moving between the sensor plates of the embodiment of FIG. 1;

FIG. 5*b* is a diagram which illustrates signals produced in the circuitry of FIG. 3 as a coin moves between the sensor plates of FIG. 5*a*;

FIG. 6 shows an example of an oscillator circuit which may be used in the circuit of FIG. 3;

FIG. 7 is a circuit diagram of an alternative embodiment of an oscillator circuit for detector circuitry of a coin validator.

Figure 2:
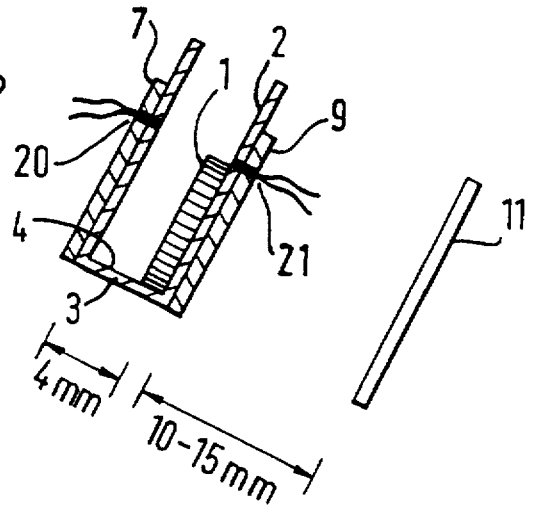
FIG. 2 is a section along the line II—II of FIG. 1.
Figure 15:
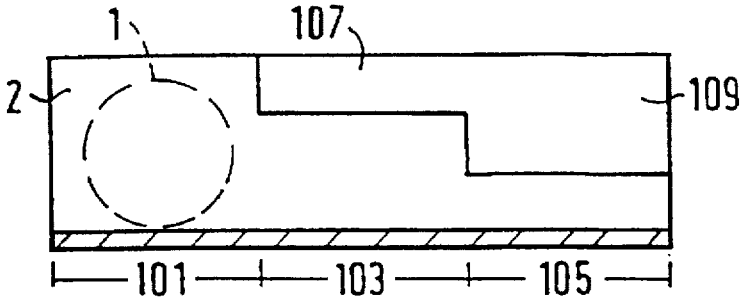
Figure 16:
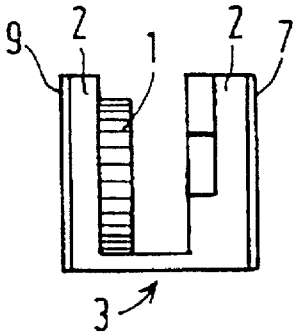
Figure 17:
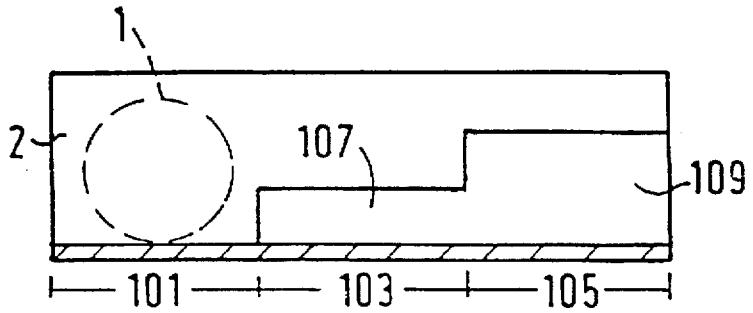
Figure 18:
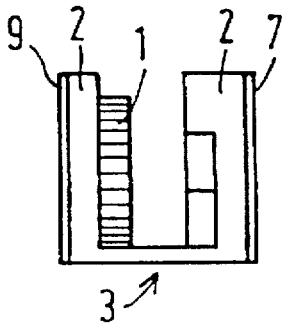
Figure 19:
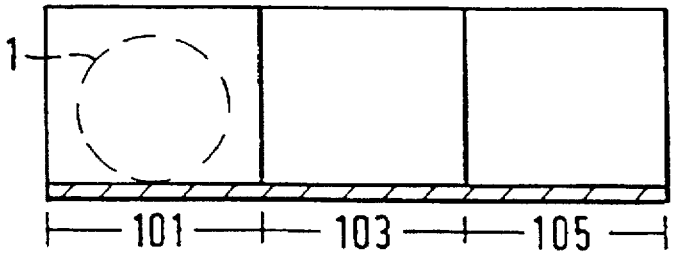
Figure 20:
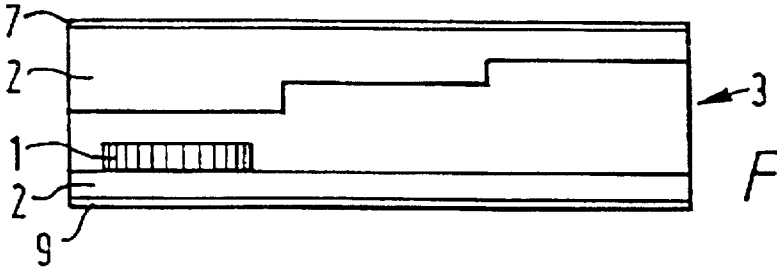
Figure 21:
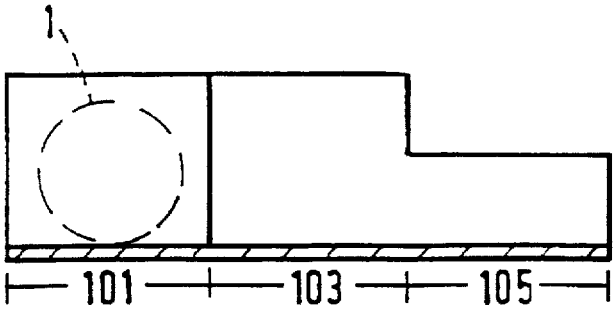
Figure 23:
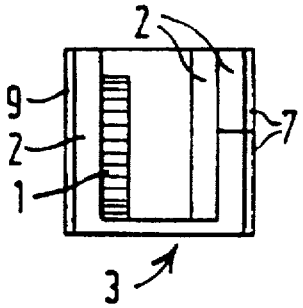
Figure 22:
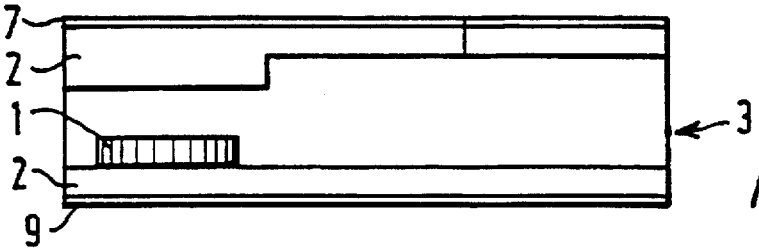
Figure 24:
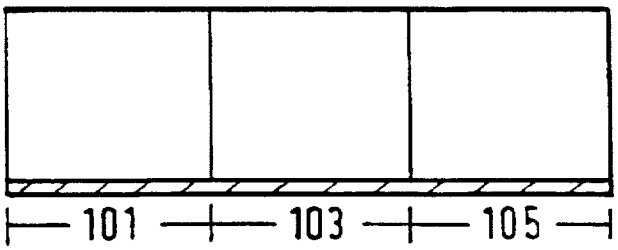
Figure 25:
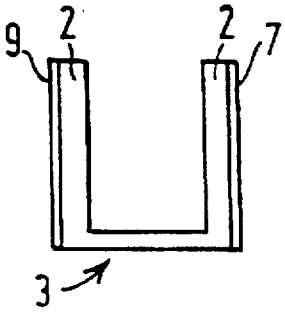
Figure 26:
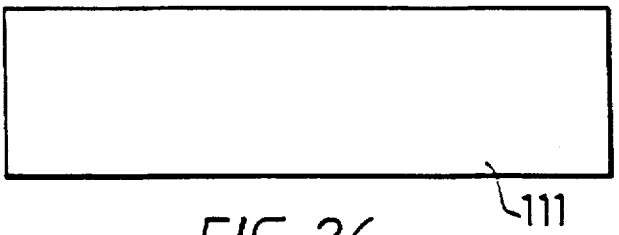
Figure 27:
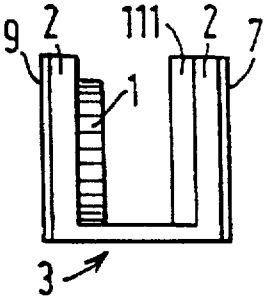
Figure 28:
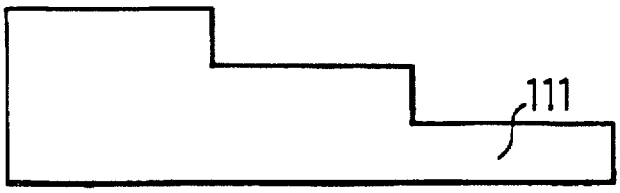
Figure 33:
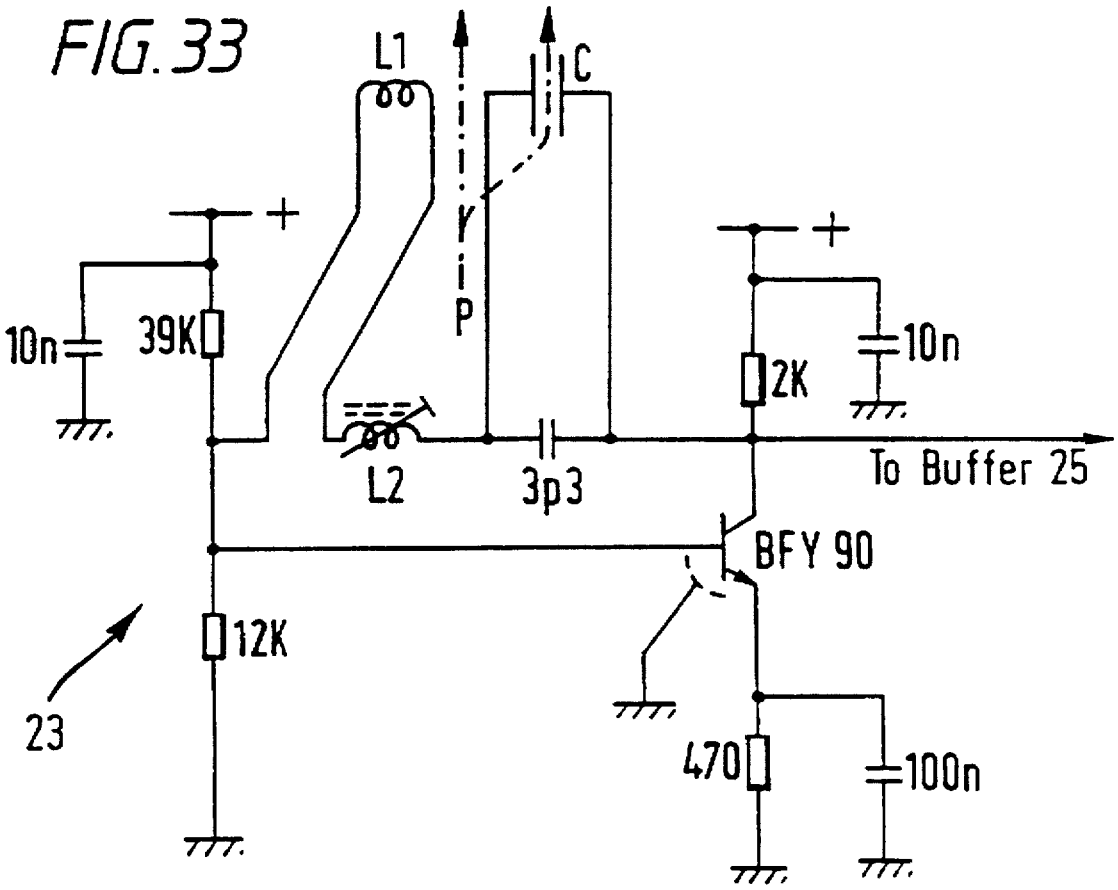
Figure 34:
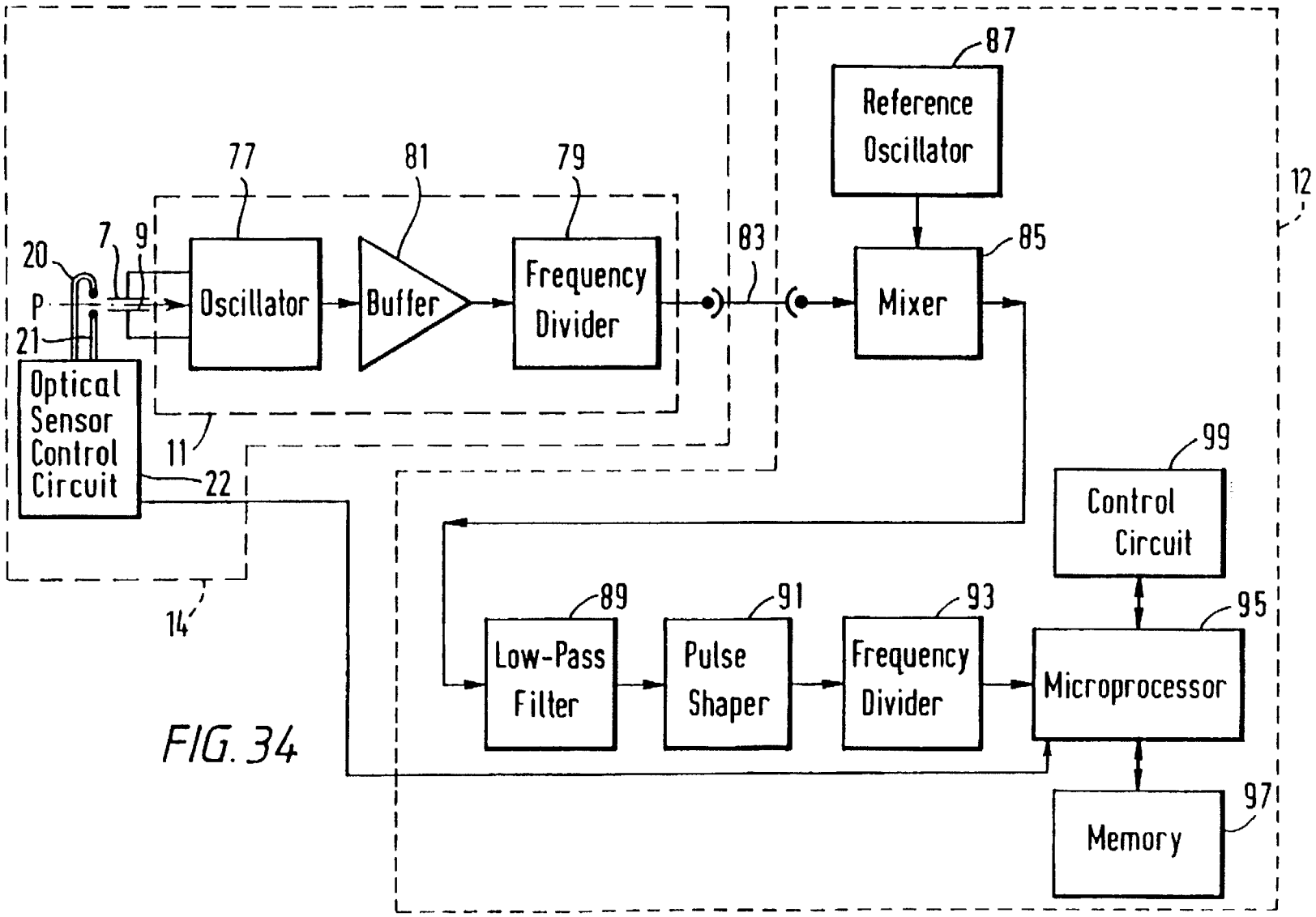

FIG. 8 is a schematic top view of a coin guide;

FIG. 9 is an electrical model of the coin guide of FIG. 8;

FIG. 10 is a schematic top view of the coin guide of FIG. 8 when a coin is passing along it;

FIG. 11 is an electrical model of the coin guide of FIG. 10 together with the coin;

FIGS. 12*a* and 12*b* are diagrams similar to FIGS. 5*a* and 5*b* but showing a second embodiment;

FIGS. 13*a* and 13*b* are diagrams similar to FIGS. 5*a* and 5*b* but showing a third embodiment;

FIGS. 14*a* and 14*b* are diagrams similar to FIGS. 5*a* and 5*b* but showing a fourth embodiment;

FIG. 15 is a schematic side view of a side wall of a coin guide according to a fifth embodiment;

FIG. 16 is a schematic end view of the coin guide of the embodiment of FIG. 15;

FIG. 17 is a schematic side view of the side wall of a coin guide in a sixth embodiment;

FIG. 18 is a schematic end view of the coin guide of the embodiment of FIG. 17;

FIG. 19 is a schematic side view of a side wall of a coin guide in a seventh embodiment;

FIG. 20 is a schematic top view of the coin guide of the embodiment of FIG. 19;

FIG. 21 is a schematic side view of a side wall of a coin guide in a eighth embodiment;

FIG. 22 is a schematic top view of the coin guide of the embodiment of FIG. 21;

FIG. 23 is a schematic end view of the coin guide of the embodiment of FIG. 21;

FIG. 24 is a schematic side view of the side wall of a coin guide in a ninth embodiment;

FIG. 25 is a schematic end view of the coin guide of the embodiment of FIG. 24;

FIG. 26 is a schematic side view of an insert for attaching to a side wall of a coin guide;

FIG. 27 is a schematic end view of a coin guide with the insert of FIG. 26;

FIG. 28 is a schematic side view of an insert of stepped height;

FIG. 29 is a schematic top view of an insert with stepped thickness;

FIG. 30 is a schematic side view of an insert with regions of different electrical permittivity;

FIG. 31 shows a section similar to FIG. 2 but showing a further embodiment of the invention;

FIGS. 32*a* and 32*b* are similar to FIGS. 5*a* and 5*b* but showing the embodiment of FIG. 31;

FIG. 33 is an example of an oscillator circuit for use in the embodiment of FIGS. 31 and 32, which circuit is a modification of the circuit of FIG. 6; and FIG. 34 is an electrical block diagram showing an alternative circuit to that shown in FIG. 3.

FIGS. 1 to 4 show a coin validation system, which is for receiving and discriminating between valid and invalid coins and determining the denomination of valid coins. The system comprises a coin sensing portion 14, shown in schematic side view in FIG. 1.

In FIG. 1, a coin 1 enters the coin sensing portion 14 through an aperture 15, and rolls down a longitudinally inclined guide 3 which defines a coin path P.

As the coin 1 rolls down the guide 3, it passes between conductive plates 7, 9, which form a capacitor. The presence of the coin 1 between the conductive plates 7, 9 will alter the capacitance of the capacitor, and this alteration is detected by a detection circuit 11 as will be described later. As can be seen in FIG. 2, the conductive plates 7, 9 are provided on the outside of walls of the guide 3, so that the coin 1 does not contact them. This protects the conductive plates 7, 9 from mechanical abrasion by the coin 1. Additionally, the guide 3 is made of non-conductive material so as to insulate electrically the conductive plates 7, 9 from each other.

The guide 3 has a U-shaped section, with a wall-to-wall separation of about 4 mm. It is also inclined laterally as shown in FIG. 2. The lateral inclination is not shown in FIG. 1 for clarity. The lateral inclination of the guide 3 causes the coin 1 to rest against side wall 2 of the guide 3 as well as resting on the floor 4 of the guide 3. Consequently the radial direction of the coin 1 is maintained parallel to the conductive plates 7, 9 and the position of the coin across the width of the gap between the conductive plates 7, 9 is determined. This causes all coins to follow the same coin path P, to enable consistent detection of coins.

The conductive plates 7, 9 preferably extend from the bottom of the guide 3 up to a height equal to or slightly greater than the height of the greatest diameter coin intended to be accepted by the validator.

The conductive plates 7, 9 may be provided by any convenient method, such as plating them onto the guide 3 using printed circuit techniques, printing them with a conductive ink, or by adhering pieces of metal (e.g. copper or copper alloy) foil to the guide 3.

The detection circuit 11 is provided on a circuit board mounted alongside the guide 3, and spaced about 10 mm to 15 mm from it, as shown in FIG. 2.

The sensing portion 14 of the coin validation system is enclosed in a protective box 13, which may be RF-shielding, in which aperture 15 is provided. At the end of the guide 3 the coin 1 leaves the protective box 13 through an exit aperture 17.

FIG. 3 shows the electrical circuit of the coin validation system in block form. The detection circuit 11, for detecting alteration in the capacitance of the capacitor formed by the conductive plates 7, 9, is provided inside the protective box 13. It is connected to a signal processing portion 12, which is outside the protective box 13, by a coaxial cable 19.

As shown in FIG. 3, the detection circuit 11 comprises an oscillator circuit 23 to which the conductive plates 7, 9 are connected. The frequency at which the oscillator circuit 23 oscillates depends on the capacitance of the capacitor formed by the conductive plates 7, 9. The oscillator circuit 23 is tuned to oscillate at a predetermined nominal rest frequency, for example 192 MHz, when no coin is present between conductive plates 7, 9. The oscillator circuit 23 has an output fed via a buffer 25 to a frequency divider 27. The frequency divider 27 divides the frequency of its input by, for example, 32 to produce a nominal rest output frequency of, for example, 6 MHz when no coin is present between conductive plates 7, 9. The rest frequency is the frequency when no coin is present.

The oscillator circuit 23 may be implemented as shown in FIG. 6, in which capacitor C represents the capacitance of the conductive plates 7, 9 and the path P of the coin 1 is shown passing between the conductive plates 7,9. In FIG. 6, the oscillator circuit 23 is an LC tuned oscillator. The values of the capacitance and inductance in the circuit will determine the oscillator frequency. The capacitance provided by the conductive plates 7, 9 can be arranged to be of the order of 2 to 3 pF. This should provide a significant proportion of the total capacitance in the circuit, so that alterations of this capacitance due to the presence of a coin will result in a detectable change in the resonant frequency.

In the circuit of FIG. 6, the collector of the transistor in the oscillator circuit 23 has a low impedance connection to ground for a.c. signals at the resonant frequency whereas the connection between the capacitors and the inductor has a high impedance connection to ground for a.c. signals at the resonant frequency. Therefore the conductive plate connected to the collector of the transistor has a low impedance connection to ground via the 2k ohm collector resistor and the conductive plate connected to the inductor has a high impedance connection to ground. The conductive plate with the high impedance connection is more sensitive to unwanted external signals, and therefore circuit operation is improved if it is given additional shielding. In the construction shown in FIG. 2, this is conveniently provided by arranging the circuit board carrying the detection circuit 11 so that the conductive plate with the high impedance connection is sandwiched between the conductive plate with the low impedance connection and the circuit board. In this way shielding is provided by the conductive plate with the low impedance connection and by the ground plane of the circuit board.

As shown in FIG. 6, the buffer 25 may be provided by an emitter follower stage, which prevents the input of the frequency divider 27 loading the oscillator circuit 23 excessively.

Returning to FIG. 3, the 6 MHz output of the frequency divider 27 is fed via the co-axial cable 19 to a pulse shaper 29 of the signal processing portion 12. The pulse shaper 29 squares the waveform of the signal received over the co-axial cable 19 and provides it to the clock input of a counter 31. The counter 31 is controlled by a microprocessor 35 to count the oscillations of the signal received at its clock input from the detection circuit 11. At the end of a predetermined counting period, for example a 10 ms period, the counter 31 is stopped by the microprocessor 35 and the contents of the counter 31 are loaded in parallel into a shift register 33 under control of the microprocessor 35. When the contents of the counter 31 have been loaded into the shift register 33, the counter 31 is reset and starts counting for the next counting period. The contents of the shift register 33 are then serially loaded into the microprocessor 35.

Therefore, at the end of each counting period the microprocessor 35 receives, via shift register 33, the count value of the counter 31. This count value equals the number of output cycles of the frequency divider 27 of the detection circuit 11 during the counting period. Consequently, this count value gives a measure of the frequency of the signal produced by the oscillator circuit 23.

The presence of a coin between conductive plates 7, 9 will alter the oscillation frequency of the oscillator circuit 23, and consequently it will alter the count value received by the microprocessor 35. Different coins will tend to alter the oscillation frequency by different amounts, and accordingly the microprocessor 35 can distinguish between coins on the basis of the count value. In order to enable the microprocessor 35 to do this, a look-up table is provided in a memory 37. The look-up table stores coin denomination information with reference to count value.

The degree to which the presence of a coin between the conductive plates 7, 9 alters the oscillation frequency of the oscillator circuit 23 will depend on the thickness and diameter of the coin 1, and possibly on its composition and construction. Accordingly, it is possible for differences in these factors to cancel out and for different coins of different diameters to have substantially the same effect on the oscillation frequency. In order to enable the system to distinguish between such coins, an optical diameter detection system is provided. This comprises an LED 20 and an optical sensor 21 positioned opposite each other on the guide 3 of FIG. 1. The LED 20 and optical sensor 21 are spaced at a predetermined height above the floor 4 of the guide 3. A coin of greater diameter than the predetermined height will intercept the light beam from the LED 20 to the optical sensor 21, and accordingly it can be distinguished from a coin of lesser diameter than the predetermined height. The predetermined height is chosen so as to distinguish between pairs of coins which have similar effects on the oscillation frequency of the oscillator circuit 23.

The LED 20 is powered by an optical sensor control circuit 22, which also receives the output signal from the optical sensor 21. The optical sensor control circuit 22 outputs an optical sensing signal to the microprocessor 35.

As shown in FIG. 4, the memory 37 comprises three registers, Store A 41, Store B 43 and Difference register 45 and the look-up table 47. Store A 41 contains a reference frequency value of 60000 (the number of oscillation of a 6 MHz signal in 10 ms counting period).

In each count period, the count value from the shift register 33 is loaded into Store B 43. The microprocessor 35 then calculates the difference between the count value in Store B 43 and the reference frequency value in Store A 41. The difference is stored in the Difference register 45.

It will be appreciated by those skilled in the art that a coin 1 passing between conductive plates 7, 9 will increase the capacitance provided by the conductive plates, and therefore will reduce the frequency of the signal from the oscillator circuit 23. Therefore, the maximum frequency of the signal will be the 192 MHz frequency output when no coin is present between the conductive plates 7, 9. Thus the number of pulses supplied to the counter 31 in a 10 ms counting period will not exceed 60000, which is well within the counting range of a 16-bit binary counter. Preferably, therefore the counter 31 and the shift register 33 are both 16-bit binary devices, and Store A 41 and Store B 43 are 16-bit registers.

A relatively large coin, such as the British £1 and 50 p coins, may alter the capacitance of the conductive plates 7, 9 by about 0.7 pF, and the corresponding change in the frequency of the oscillator circuit 23 will result in a difference between the value stored in Store A 41 and the value stored in Store B 43 which can be represented as a 12-bit binary number. Slight instabilities in the oscillator circuit 23 may cause slight variations in the precise 12-bit value, but these can be accommodated by discarding the bottom 4 bits, and storing only the top 8 bits in the Difference register 45. Consequently, the Difference register 45 can be implemented by an 8-bit register.

FIGS. 5*a* and 5*b* illustrate the difference values stored in the Difference register 45 for successive 10 ms counting periods as a coin 1 passes between the conductive plates 7, 9. As a coin 1 enters the space between the conductive plates 7, 9 (position 1*b* in FIG. 5*a*) the difference value stored in the Difference register 45 by the microprocessor 35 in each counting period will increase rapidly to a maximum as shown in FIG. 5*b*. The maximum value is maintained while the coin 1 is fully between the conductive plates 7, 9 (e.g. at position 1*a*) and then decreases sharply as the coin 1 leaves the conductive plates 7, 9 (at position 1*c*). When the coin has fully left the conductive plates 7, 9 (at position 1*d*) the difference value returns substantially to zero. The microprocessor 35 determines the maximum frequency difference and uses it to interrogate the look-up table 47.

The look-up table 47 contains an entry for each possible difference value determined by the microprocessor 35 and corresponding coin validation information. For each possible difference value, the microprocessor 35 receives information enabling it to determine whether the coin is valid or invalid, and also to determine the denomination of a valid coin. The optical sensing signal from the optical sensor control circuit 22 is also input to the look-up table 47. Table 1 gives an example of the contents of the look-up table 47. Different systems will have different values for each valid coin, and the values given are just an example.

TABLE 1

| Optical Sensing Signal | | |
|---|---|---|
| Difference Value | 0 | 1 |
| 1 to 44 | Invalid | Invalid |
| 45, 46 | 5p | Invalid |
| 47 to 67 | Invalid | Invalid |
| 68 to 70 | 20p | Invalid |
| 71 to 84 | Invalid | Invalid |
| 85 to 89 | new 10p | Invalid |
| 90 | new 10p | 2p |
| 91 to 93 | Invalid | 2p |
| 94 to 154 | Invalid | Invalid |
| 155 to 158 | Invalid | old 10p |
| 159 to 193 | Invalid | Invalid |
| 194 | £1 | Invalid |
| 195 | £1 | 50p |
| 196 upwards | Invalid | Invalid |

Table 1 refers to British coins.
"new 10p" means the style of 10p coin introduced in 1992.
"old 10p" means the style of 10p coin withdrawn in 1993.

As can be seen from Table 1, a difference value of 90 can be either the highest acceptable difference value for a new (1992) ten pence piece or the lowest acceptable difference value for a two pence piece. Similarly a difference value of 195 indicates either a one pound coin or a fifty pence coin. The height of the LED 20 and the optical sensor 21 above the floor 4 of the guide 3 is chosen so as to enable both of these ambiguities to be resolved by the optical sensing signal. The output of the optical sensor control circuit 22 will indicate '1' for a two pence coin and a fifty pence coin and '0' for a one pound coin and new ten pence coin.

If the difference value from the look-up table 47 corresponds to a valid coin, the microprocessor 35 indicates to a control circuit 39 that the coin 1 is a valid coin of the denomination indicated by the look-up table 47. In response to this coin validation information the control circuit 39 will control the operation of, for example, the coin operated telephone or vending machine. If the difference value received by the microprocessor 35 corresponds in the look-up table 47 to an invalid coin, the microprocessor 35 will inform the control circuit 39 of this, and the control circuit 39 may e.g. reject the coin 1.

In FIG. 3, the control circuit 39 is shown separately from the microprocessor 35. In practice it may be a separate piece of hardware or alternatively its function may be implemented by a program run in the coin validation microprocessor 35.

The circuit of FIG. 3 is advantageous because it can be constructed to operate with a power consumption of about 10 mA with a 4.5 V or 5 V supply, especially if the control function of the control circuit 39 is provided by software within the microprocessor 35. This power consumption is sufficiently low that the circuit can act as a coin validator in a payphone powered only by the power available from the telephone line connection. In this way, the need for electric power cells or a mains electricity connection can be avoided. The most significant power consumption in the circuit is typically in the frequency divider 27. If this is provided by an emitter coupled logic high speed chip such as chip type SP 8797 of Plessey Semiconductors, it will draw about 7 mA.

In a modification, the microprocessor 35 varies the reference frequency value stored in Store A 41 in response to variations in the count value obtained in the absence of a coin. Such variations may occur, for example, owing to changes in the oscillation frequency of the oscillator circuit 23 with temperature. In this modification a count value is supplied to the microprocessor 35 from 16-bit counter 31 in each counting period and is stored in Store B 43 of memory 37. Then the difference is calculated between the values stored in Store A 41 and Store B 43. If the value in Store A 41 is greater than the value in Store B 43, Store A 41 is incremented by 1 and if the difference is the other way round, Store A 41 is decremented by 1. Thus, whilst no coin is present in the sensing portion 14 of the coin validator, a value which follows the frequency of the oscillator signal is maintained in Store A 41 of memory 37, and the system is automatically compensated for frequency drift in the oscillator circuit 23.

Depending on the circuit parameters, such drift compensation may be important. For example, in the circuit described above a frequency drift of 0.1% in the oscillator circuit will change the count value in Store B 43 by 60. If the value in Store A 41 is not altered correspondingly, the difference values will also change by 60 and a look-up table in accordance with Table 1 would cease to provide the correct output.

The microprocessor 35 can be programmed to identify the presence of a coin 1 from a large difference value, e.g. a value in excess of 20 in the case of the Table 1 difference values, and may suspend its function for updating the contents of Store A 41 under these circumstances. This prevents the updating function from artificially reducing the difference values generated by the coin. However, if the microprocessor 35 is programmed to use the largest difference value obtained from a coin, and the contents of the look-up table 47 are prepared appropriately, it may not be necessary to turn off the updating function. In this case, any difference value which has been significantly reduced by the effect of the updating function will not be the largest value, and accordingly it will not be used for coin validation. Since the updating function only changes the value of Store A 41 by 1 in each counting period, however great the difference value is, the value of Store A 41 is only altered slightly by the updating function during the time a coin passes between the conductive plates 7, 9, and the updating function will return Store A 41 to the correct value before the next coin arrives.

As will be appreciated by those skilled in the art there are other ways in which the circuit can track frequency drift in the oscillator circuit. For example, a compensation value may be stored in the memory 37. The microprocessor may increment or decrement this compensation value instead of the value in Store A 41. Alternatively, the difference value between the values in Store A 41 and Store B 43 when no coin is present may be stored as the compensation value. The compensation value is used Lo compensate the difference value in the Difference Register 45 or the values read from the look-up table 47 when a coin is present.

In order to enter difference values for valid coins into the look-up table 47, the microprocessor 35 may be set into a training mode. When the microprocessor 35 is in the training mode a number of valid coins may be passed through the coin validator and the microprocessor 35 will store in the look-up table 47 a range of frequency differences and optical sensor pair input values which represent each of the valid coins. The training exercise above will normally be carried out for each coin validation system separately although in some cases it may be possible for training to be carried out centrally and an updated look-up table reproduced and provided to other suitable coin validation systems by exchanging memory chips.

Suitable values for the inductance and the capacitance in the circuit of FIG. 6 can provide a resonant frequency of around 200 MHz (e.g. 192 MHz as previously stated).

Provided that the frequency divider 27 can operate at higher input frequencies, the resonant frequency of the oscillator circuit 23 can be increased above 200 MHz by replacing the 3.3 pF capacitor in parallel with the conductive plates 7, 9 by a lower value capacitor, or removing it altogether. This will tend to increase the effect of a coin 1 on the resonant frequency. Reducing the value of the inductor will also increase the resonant frequency of the circuit, but the value of the inductor should be maintained large in comparison with the inherent inductance of the circuit wiring and other components to ensure that the circuit operates in a predictable manner. In practice it may be difficult to provide a circuit having a resonant frequency above about 0.5 GHz.

The oscillator circuit 23 can also be arranged to have a resonant frequency lower than 192 MHz. If a much lower frequency is desired, the circuit designer should take account of the consequences of this on the operation of the analysis circuit. If the total circuit capacitance is increased to lower the frequency, the effect of the coin 1 on the frequency will tend to reduce, making it harder to detect the presence of a coin 1 and to distinguish between different coins. If the total circuit capacitance is maintained unchanged, and the resonant frequency is lowered solely by increasing the inductance in the circuit, the effects of the inherent resistance and inherent capacitance of the inductor become more significant, causing unsuitable circuit operation. The analysis circuit of FIG. 3 throws away the bottom 4 bits of the difference between the counter value stored in Store B 43 and the reference value stored in Store A 41. These bits are treated as noise due to frequency instability in the oscillator circuit 23. Consequently, the smallest detectable frequency change is one which leads to a change of at least 16 in the value counted by the counter 31, which is a change of about 0.027%. Under these circumstances, it is difficult in practice to provide a usable oscillator circuit with a resonant frequency below 10 MHz, and a resonant frequency above 20 MHz will normally be necessary. Preferably the resonant frequency is at least 50 MHz, more preferably at least 100 MHz.

However, if the oscillator circuit 23 is sufficiently stable, some or all of the lowest 4 bits of the calculated difference can be relied on as a measure of coin characteristics, instead of being ignored as noise. In this case, a smaller percentage change in oscillator frequency is measurable, provided that the lowest 4 bits of the calculated difference between the values in Store A 41 and Store B 43 are not thrown away before the difference value is stored in the Difference register 45. The ability to measure a smaller percentage frequency change allows the capacitance in the oscillator circuit to be increased. This in turn allows the operating frequency of the oscillator circuit 23 to be reduced. If the circuit of FIG. 3 is modified in this way, it may be possible to increase the capacitance in parallel with the conductive plates 7,9 to 10 to 15 pF, and to select the inductance to bring the nominal operating frequency of the circuit to 12 MHz.

In this modification, the circuit of FIG. 3 is further modified by removing the frequency divider 27. The pulse shaper 29 now receives a signal at 12 MHz instead of 6 MHz. The counter 31 is operated as before, but in 10 ms it will overflow once so that its output will be in effect the bottom 16 bits of a 17 bit count. The value in Store A 41, representing the count value for 12 MHz, will nominally be 54464 (the excess of 120000 counts over the overflow value of the counter 31, which is 65536), but it can be updated to track frequency drift as discussed above. The Difference register 45 may store the full 12 bits of the calculated difference, or it may store an 8-bit difference value by choosing the appropriate 8 bits to provide reliable coin identification (e.g. with a particular set of valid coins the top 1 bit may be discarded as unchanging and the bottom 3 bits may be discarded as noise, leaving 8 bits as the difference value). Otherwise, the system works as previously described. This modification allows the frequency divider 27 to be omitted, thereby reducing the overall power consumption. This eases the power consumption constraints on other circuit components, even if the total power consumption is limited to 5 mA at 4.5 or 5V.

With this modification, the lowest practical oscillator frequency for the oscillator circuit 23 can be reduced below 10 MHz, to 5 MHz or even to 1 MHz.

In FIG. 7 a circuit diagram is given of an alternative embodiment for the oscillator circuit 23, together with its associated output buffer 25. Some other associated circuitry is also shown.

In FIG. 7, a resonating circuit is formed by capacitor C1 and inductor L1. The conductive plates 7, 9 are connected across terminals JP1, to provide an additional capacitance in parallel with the capacitor C1. Terminals JP2 are normally shorted together. In this way, an LC oscillator is provided having a natural oscillation frequency which is altered by the presence of a coin between the conductive plates 7, 9 of the coin guide 3.

The oscillator is driven by transistors Q2 and Q3. These two transistors have identical dc bias arrangements for their bases, which are connected through respective resistors R7 and R8 to a common node which is in turn connected through matching resistors R5 and R6 to both the positive line voltage V2 and the negative line voltage Vss. The oscillating voltage from the junction between capacitor C1 and inductor L1 is applied to the base of transistor Q3 through dc isolating capacitor C4, and is also applied directly to the collector of Q2. Thus, when the junction between capacitor C1 and inductor L1 is high, transistor Q3 is turned on through C4 and current flows through emitter resistor R13, which is common to both transistor Q3 and transistor Q2. This raises the emitter potential, tending to turn transistor Q2 off, so that its collector connected to the junction between capacitor C1 and inductor L1 can remain high. When the junction between the capacitor C1 and inductor L1 goes low, transistor Q3 is turned off through capacitor C4, so that it does not provide any current to emitter resistor R13, so that the emitter voltage can fall to the line voltage Vss, and transistor Q2 will tend to turn on owing to its dc bias through resistor R7. Thus, it will tend to conduct current from its collector, pulling down the junction between capacitor C1 and inductor L1. In this manner, the circuit of transistors Q2 and Q3 drives the oscillator.

The output signal is taken from the collector of transistor Q3, which in this respect acts as a common emitter coupled amplifying transistor. Inductance L2 is provided so that the collector load for transistor Q3 is partly inductive.

The buffer 25 is provided by pnp transistor Q4, which also acts as a common emitter connected amplifier, and provides its output from its collector through dc isolating capacitor C11. Coil L3 provides an inductive collector load for transistor Q4, to magnify the voltage swing at the collector of transistor Q4.

The oscillator circuit of FIG. 7 is preferred at present, because it appears to provide better stability of the oscillator frequency with changes of temperature and changes of component values over time as compared with the circuit of FIG. 6.

Because of the good stability of the circuit of FIG. 7, its component values can be selected to provide an oscillation frequency of 6 MHz in the absence of a coin 1. Accordingly, the frequency divider 27 of FIG. 3 is not used. The output from the buffer transistor Q4 is provided through the capacitor C11 to an input of an application specific integrated circuit (ASIC). A diode D1 acts as a dc clamp/level shifter, to ensure that the input to the ASIC does not go lower than about 0.4 volts below line voltage Vss, to ensure that the oscillating voltage provided to the ASIC is within a suitable voltage range. The pulse shaper 29 of FIG. 3 is not required, because the inductance L3 ensures that the voltage swing at the input to the ASIC is sufficient to clock the counter 31.

The ASIC contains the counter 31 and shift register 33 of FIG. 3. It provides an output for the microprocessor 35 and has input connections to receive signals from the microprocessor. The circuit of FIG. 7 is designed for use in a pay telephone, in which the microprocessor 35 is provided on the main circuit board of the telephone, and the ASIC is connected to the microprocessor through a plug connector PL1 for connecting the coin validator circuit board to the main circuit board of the telephone. In this embodiment, the circuit can be constructed to operate with a power consumption of about 5 mA at 4.5V or 5V.

The counter 31 in the ASIC receives the output of buffer 25, and the remainder of the analysis circuit operates as described above with reference to FIG. 3, except that at least some of the lowest 4 bits of the calculated difference are used to determine the characteristics of the input coin. Preferably, all the bits of the difference are used, and the Difference Register 45 is a 12-bit register storing all bits of the difference value. Accordingly the look-up table 47 contains 12-bit values, between 0 and 4095 (or 000 and FFF in hexadecimal notation). Table 2 gives an example of the contents of the look-up table 47 using 12-bit values.

TABLE 2

| Optical Sensing Signal | | |
|---|---|---|
| Difference Value | 0 | 1 |
| 0–158 | Invalid | Invalid |
| 159–165 | 5p | Invalid |
| 166–279 | 20p | Invalid |
| 280–298 | Invalid | Invalid |
| 299–354 | new 10p | Invalid |
| 355–397 | 2p | Invalid |
| 398–765 | Invalid | Invalid |
| 766–812 | Invalid | 50p |
| 813–816 | £1 | 50p |
| 817–891 | £1 | Invalid |
| 892 upwards | Invalid | Invalid |

In Table 2 the old 10 p coin is not recognised as a valid coin.

In this example, the new 10 p coin and the 2 p coin can be discriminated on the basis of the difference value without confusion, and the optical sensing arrangement is used only to discriminate between the £1 coin and the 50 p coin.

As an alternative it may be convenient to provide the Difference Register 45 as a 16-bit register, similar to the Store A and Store B registers, even though the difference value is unlikely to require more than 10 or 11 bits.

In the circuit of FIG. 7 the plug connector PL1 also carries connections by which the microprocessor 35 is able to drive one or two optical detector devices S1, S2. These are units which comprise a light emitting diode associated with a photosensitive transistor, arranged so that if a coin is present the light emitted by the diode will be reflected back to the unit and detected by the photosensitive transistor. Line 1 of the plug connector PL1 is a drive line for the light emitting diodes. When this line goes high, transistor Q1 turns on and current passes through the light emitting diodes, causing them to emit light. If a coin is present adjacent the optical sensor unit, light will be reflected onto the associated photosensitive transistor, which will conduct, so that potential will be dropped across its respective collector resistor R9, R10. If no coin is present the transistor will not conduct and its collector voltage will remain close to line voltage V1. The collectors are connected to the plug connector PL1, to provide outputs signals opto 1 and opto 2 back to the main board of the telephone. Each optical sensor unit provides an equivalent to the LED 20 and the optical sensor 21.

In practice, if only one optical sensor unit is required, unit S1 may be omitted and the position of its light emitting diode is shorted by providing a link between terminals JP3.

The optical sensor unit S2 is used to detect when a coin enters the coin guide 3, before it reaches the conductive plates 7, 9, so as to prepare the microprocessor 35 for conducting a coin validation operation.

The optional optical sensor S1 can be used to provide a coin height discriminator, to distinguish between large diameter coins and small diameter coins having the same effect as each other on the capacitance between the conductive plates 7, 9, as described above with reference to the LED 20 and the optical sensor 21. Alternatively it can be used as part of an arrangement to detect attempts fraudulently to remove a coin from the coin guide 3 after insertion. However, it is preferred where possible to choose a width for the coin guide 3 and arrangement for the conductive plates 7, 9 such that there is no confusion between the coins of the coin set with which the validator is intended to be used. Additionally, fraudulent withdrawal of a coin after it has been inserted into the coin guide can alternatively be prevented by mechanical means, such as a flap which is pressed down by the coin as it enters the guide and which rises behind the coin to prevent fraudulent withdrawal.

The circuit of FIG. 7 can be constructed on a single circuit board, with the microprocessor 35 on the main control circuit board of the payphone or other apparatus controlled by the coin validator. Conveniently, all of this circuitry can be provided inside the protective box 13, so that connections may be provided by simple wires and the co-axial cable 19 is not required.

If a coin is strongly electrically conductive, its effect on the capacitance between the conductive plates 7,9 will largely be a function of its area (i.e. a function of its diameter) and its thickness. While the coin is between the conductive plates 7, 9, its electrically conductive substance will replace part of the air in the gap between the conductive plates 7, 9, and accordingly it will reduce the effective thickness of the dielectric for part of the capacitor formed by the conductive plates 7, 9. The part of the capacitor which is affected in this matter will be the part where the coin is present, that is to say, the part defined by projecting the outline of the coin onto the conductive plates 7,9. Therefore the larger the area of the coin is, the greater is the part of the capacitor which is affected. The degree to which the capacitance of the affected part of the capacitor is altered depends on the thickness of the coin. The greater the thickness of the coin is, the more it will reduce the effective thickness of the dielectric of the affected part of the capacitor.

Accordingly, a thin coin of large area will have a small effect over a large part of the capacitor and a thick coin of small area will have a large effect over a small part of the capacitor, and it is possible that the overall effect on the capacitor will be the same in each case. If the width between the conductive plates 7, 9 is altered without changing the size of the conductive plates 7, 9, the effect of the area of a coin on the capacitance is unchanged but the effect of coin width on the capacitance is altered. Therefore, where a pair of coins, one thin and large area and the other thick and small area, have similar effects on the capacitance and are hard to distinguish, use of a different separation between the conductive plates 7, 9 will render them disninguishable. However, a different pair of coins which were previously distinguishable may become hard to distinguish. For any given set of coins, it may be possible to find a convenient separation between the conductive plates 7, 9 which allows all the coins to be distinguished by their effects on the capacitance, or it may be necessary to provide other means such as the LED 20 and optical sensor 21 to distinguish between certain coins. In effect, the other means is provided so that two detection values are obtained for each coin, and coins which are difficult to distinguish on the basis of one of the detection values are distinguished on the basis of the other detection value. This also improves the performance of the system in detecting invalid coins. Alternative ways of obtaining more than one detection value will now be described.

It is convenient first to discuss a mathematical treatment of the capacitor formed by the coin guide 3, both in the absence of a coin and in the presence of a coin.

The simplest mathematical treatment is to ignore the existence of the walls 2 of the coin guide 3, and treat the capacitor as consisting only of the conductive plates 7,9 and the air gap in the channel between the side walls 2 of the coin guide 3. Since the relative permittivity of air is very close to 1, this leads to the following expression for the capacitance C formed by the conductive plates 7,9.

$$C=Eo\times Ap/D \quad (1)$$

where Eo is the dielectric constant, Ap is the area of the conductive plates 7,9, and D is the distance between the conductive plates 7,9.

To provide a more accurate treatment, the side walls 2 of the coin guide 3 should be taken into account. FIG. 8 is a schematic view from above of the coin guide 3 together with the conductive plates 7,9, and FIG. 9 is an electrical model of the construction of FIG. 8. The total capacitance C between the conductive plates 7,9 is now treated as being the overall capacitance of three capacitors C1,C2,C3 in series. C1 is the capacitance of the air gap between the side walls 2 of the coin guide 3, the air gap having a width D1. C2 is the capacitance of the side wall 2 next to the first conductive plate 7, the side wall having a thickness D2. C3 is the capacitance of the side wall 2 of the coin guide 3 next to the second conductive plate 9, the side wall having a thickness D3. Accordingly, the values for the three capacitors can be given as follows:

$$C1=Eo\times Ap/D1 \quad (2)$$

$$C2=Eo\times Er\times Ap/D2 \quad (3)$$

$$C3=Eo\times Er\times Ap/D3 \quad (4)$$

where Er is the dielectric constant for the insulating material (e.g. plastics) of the side walls 2 of the coin guide 3. It is assumed that the side walls 2 are made of the same material as each other, although it would be possible to make them out of different materials and accordingly the value of Er might differ between equation (3) and equation (4).

When a coin 1 is passing along the coin guide 3 between the conductive plates 7,9, the capacitance between the conductive plates 7,9 is altered by the presence of the coin. FIG. 10 is a schematic top view of the coin guide 3 with a coin 1 present between the conductive plates 7,9, and FIG. 11 is an electrical model of FIG. 10.

In the electrical model of FIG. 11, the part of the area of the plates 7,9 where the coin is absent is treated separately from the area where the coin is present, so that the model provides two capactive paths in parallel. The left hand path in FIG. 11 has an overall capacitance CA, and is made up of capcitances C10,C20 and C30 in series, where C10,C20 and C30 correspond to C1,C2 and C3 in FIG. 9 but are the capacitances of the air gap and the side walls for the part of the area of the conductive plates 7,9 where the coin is absent. The right hand path in FIG. 11 has an overall capacitance CB, and is made up of capacitances C11,C12,C21 and C31 in series. C21 and C31 are the capacitances of the parts of the side walls 2 of the coin guide 3 opposite the coin 1, C12 is the capacitance of the coin 1, and C11 is the capacitance of the reduced-width portion of the air gap next to the coin 1.

In the electrical model of FIG. 11, the overall capacitance C between the conductive plates 7,9 is given by $$C=CA+CB \quad (5)$$

and the component capacitances CA and CB are given by $$CA=(C10\times C20\times C30)/[(C10\times C20)+(C20\times C30)+(C10\times C30)] \quad (6)$$

$$CB=(C11\times C12\times C21\times C31)/[(C11\times C12\times C21)+(C11\times C12\times C31)+(C11\times C21\times C31)+(C12\times C21\times C31) \quad (7)$$

The component capacitances in the model of FIG. 11 are given by:

$$C10=Eo\times(Ap-Ac)/D1 \quad (8)$$

$$C20=Eo\times Er\times(Ap-Ac)/D2 \quad (9)$$

$$C30=Eo\times Er\times(Ap-Ac)/D3 \quad (10)$$

$$C11=Eo\times Ac/(D1-Dc) \quad (11)$$

$$C12=Eo\times Ec\times Ac/Dc \quad (12)$$

$$C21=Eo\times Er\times Ac/D2 \quad (13)$$

$$C31=Eo\times Er\times Ac/D3 \quad (14)$$

where Ac is the area of the coin, Dc is the thickness of the coin and Ec is the permittivity of the coin.

When the coin 1 is electrically conductive, Ec can be regarded as infinite, and accordingly C12 can be regarded as infinite, and can be replaced in FIG. 11 by a direct connection. In this case, the value for the overall capacitance CB of the right hand path in FIG. 11 becomes $$CB=(C11\times C21\times C31)/[(C11\times C21)+(C21\times C31)+(C11\times C31)] \quad (15)$$

In order to distinguish between confusable coins, the coin guide 3 can be provided with two or more distinct portions which are different from each other in a relevant parameter (e.g. D1), such that a coin 1 has a different effect on the capacitance between the conductive plates 7, 9 when the coin 1 is in one portion as compared with when the coin 1 is in another portion. Coins which would be confusable in one portion (e.g. with one value of D1) will normally be distinguishable in a different portion (e.g. with a different value of D1).

As can be seen from equation (12) above, when a coin is not electrically conductive it has three characteristic parameters which can affect the overall capacitance C between the conductive plates 7,9. These are its permittivity Ec, its area Ac and its thickness Dc. Because the coin has three parameters, it is theoretically necessary to provide three regions of the coin guide 3 between the conductive plates 7,9 having different properties to obtain three different measurements, in order to be sure of distinguishing between otherwise confusable coins. In practice, for any given coin set, two separate regions will normally be sufficient to distinguish confusable coins. It is, of course, also possible to provide four or more distinct regions and take four or more separate values of the capacitance to provide additional coin identification values.

There is a considerable choice in the ways in which the coin guide 3 can be altered to provide different regions having different capacitive properties. Of the parameters appearing in equations (8) to (14), Eo is a physical constant and cannot be altered. The area Ap of the conductive plates 7,9 will be the same for all regions of the coin guide, since the whole area of the plates contribute to the capacitance at all times. However, it is possible to provide different capacitive properties for different regions of the coin guide 3 by providing different values for any of the width of the air gap D1, the widths D2 and D3 of the side walls 2 of the coin guide 3, and the electrical permittivity Er of the side walls 2.

Additionally, although it is not possible to construct the coin guide 3 so as to vary the permittivity Ec of the coin or the thickness Dc of the coin, it is possible to vary the effective area Ac of the coin by shaping the conductive plates 7,9 so that in one region of the coin guide only a part of the area of the coin 1 is between the plates 7,9. If the cut away part of the conductive plates 7,9 is immediately above the level of the floor 4 of the coin guide 3, both the area of the coin 1 which is not between the conductive plates 7,9, and the proportion of the total coin area represented by the area not between the plates 7,9 will be different for different diameter coins.

From the above discussion, it will also be apparent that the widths D1,D2 and D3 and the permittivity of the side walls 2 of the coin guide 3 may be varied for only part of the height of the coin guide 3, and different regions of the coin guide 3 may be provided by successively changing the height to which the value of a parameter is changed without making further changes to the value itself.

In FIG. 12*a*, the conductive plates 51 are divided into a first portion 53 and a second portion 55. In the first portion 53 the conductive plates 51 do not extend down to the bottom of the guide 3, whereas in the second portion 55 the conductive plates 51 do extend down to the bottom of the guide 3. FIG. 12*a* shows a large diameter (large area) thin coin 1' and a small diameter (small area) thick coin 1" passing between the conductive plates 51, and FIG. 12*b* shows the difference values which will be stored in difference register 45 for each counting period as the coins 1', 1" pass between the conductive plates 51. The difference values for the large diameter coin 1' are shown by circles in FIG. 12*b* and the difference values for the small diameter coin 1' are shown by crosses in FIG. 12*b*.

The difference values obtained for the coins 1', 1" when they are at positions 1'*b*, 1"*b* wholly within the second portion 55 are the same as each other, as shown in FIG. 12*b*. When the small diameter coin 1" is at position 1"*a*, wholly within the first portion 53, a substantial proportion of the coin area is below the bottom of the conductive plates 51, and its effect on the capacitance of the conductive plates 51 is much reduced. Consequently, the difference value obtained at this time is much lower. When the large diameter coin 1' is at position 1'*a*, wholly within the first portion 53, the part of the coin area below the bottom of the conductive plates 51 is a small proportion of the total area, and the difference value obtained is not much lower than the difference value obtained when the coin is within the second portion 55. Thus coins 1, 1" which are difficult to distinguish on the basis of their effects when within one of the portions 53, 55 can be distinguished easily on the basis of their effects when within the other one of the portions 53, 55. In FIG. 12*a*, optical sensor pairs 57 and 59 indicate respectively that the coin 1 is fully within the first portion 53 and the second portion 55 of the conductive plates 51.

Another embodiment of the invention as shown in FIG. 13*a* has a first plate 61 which is planar and a second plate 63 which is stepped, to form a capacitor with a first portion 65 and a second portion 67. The plates 61, 63 have a smaller separation in the first portion 65 than in the second portion 67. Consequently the capacitance of the first portion 65 is greater than the capacitance of the second portion 67. As shown in FIG. 13*b* when a coin 1 passes between the first and second plates 61 and 63 the detection circuit 11 will produce two distinct difference values. The effect of changing the separation between the conductive plates is discussed above. Since different coins which are confusible at one separation can be distinguished at another, the two distinct difference values of FIG. 13*b* allow such coins to be distinguished.

A further embodiment of the invention is shown in FIG. 14*a* where a capacitor is formed by two plates 69, the bottom edges of which slope over the distance travelled by a coin 1 between the plates 69 along coin path P. This embodiment operates in substantially the same manner as the embodiment of FIG. 12*a*, except that the difference values increase steadily with position along the plates 69 as shown in FIG. 14*b*, instead of changing in a step fashion between two levels as shown in FIG. 12*b*.

In each of FIGS. 12*a*, 13*a*, and 14*a*, optical sensor pairs 57, 59 are shown which enable the microprocessor 35 to determine when a coin 1 reaches predetermined positions between the conductive plates. However, it may be possible to program the microprocessor to identify the position of a coin 1 from the shape of the curve of successive difference values, in which case the optical sensor pairs 57, 59 may not be needed.

FIG. 15 is a side view of one of the side walls 2 of a coin guide 3 according to another embodiment, and FIG. 16 is an end view of the coin guide 3 for the same embodiment. In the embodiment of FIGS. 15 and 16 the length of the coin guide 3 can be divided into three sections 101,103,105. In the first section 101, the side wall 2 has a uniform thickness. In the second section 103, the side wall has the same thickness as in the first section 101 over most of its height, but an upper part 107 of the side wall has a reduced thickness. Referring to the mathematical analysis of equations (5) to (15), in the upper part 107 of this section 103 of the side wall 2, the width D2 of the side wall is reduced, and the width D1 of the air gap is increased.

For a coin 1 which has a large enough diameter to overlap the reduced-thickness part 107 of the side wall 2 in the second section 103, the effect of the coin 1 on the overall capacitance C of the conductive plates 7,9 will be different when the coin is in the second section 103 of the coin guide 3 from when it is in the first section 101. In cases where two coins are confusable because they have the same effect on the capacitance C of the conductive plates 7,9 while the respective coins were in the first section 101 of the coin guide 3, the effect of the reduced-thickness part 107 of the side wall 2 in the second section 103 of the coin guide 3 will tend to enable the coins to be distinguished from one another, provided that at least one the coins has sufficient diameter to overlap the reduced-thickness part 107.

In the third section 105 of the coin guide 3, a lower part of the side wall 2 retains the original thickness and upper part 109 of the side wall 2 has the same reduced thickness as the upper part 107 of the side wall 2 in the second section 103. However, in the third section 105 of the coin guide 3, the reduced-thickness part 109 of the side wall 2 extends down lower than the reduced-thickness part 107 of the side wall 2 in the second section 103. Accordingly, the effect of a coin on the overall capacitance C between the conductive plates 7,9 will be different when the coin is in the third section 105 of the coin guide than when the coin 1 is in the first section 101 or the second section 103 of the coin guide, provided that the coin has a diameter sufficient for it to overlap the reduced-thickness part 109 of the side wall 2.

In particular, it should be noted that a coin has a different effect on the overall capacitance C when it is in the third section 105 from when it is in the second section 103, although the two thicknesses for the side wall 2 are the same as in the second section 103. It is not necessary for the reduced-thickness part 109 of the side wall 2 in the third section 105 of the coin guide to have a different thickness from the reduced-thickness part 107 of the side wall 2 in the second section of the coin guide 103. The illustrated difference in the way in which the full thickness part of the side wall 2 and the reduced-thickness part of the side wall 2 are distributed, with the reduced-thickness part of the side wall 2 being greater in the third section 105 than in the second section 103, is sufficient to provide a difference in the way in which a coin 1 will affect the overall capacitance C between the conductive plates 7,9 when the coin 1 is in the respective section of the coin guide 3.

FIG. 17 is a side view of a side wall 2 of the coin guide 3 in a further embodiment of the present invention, and FIG. 18 is an end view of the coin guide 3 of FIG. 17.

In the embodiment of FIGS. 17 and 18, a side wall 2 of the coin guide 3 has reduced-thickness portions 107,109 in the second and third sections 103,105 of the coin guide 3, so as to change the effect that a coin 1 has on the overall capacitance C between the conductive plates 7,9, in a similar manner to the arrangement of FIGS. 15 and 16. However, in the arrangement of FIGS. 17 and 18 the reduced thickness parts of the side wall 2 are provided below the full thickness portions, rather than above them as in the arrangement of FIGS. 15 and 16.

With the arrangement of FIGS. 15 and 16, a small diameter coin which does not reach the level of the reduced-thickness portion 107 of the side wall in the second section 103 of the coin guide 3 will have the same effect on the capacitance between the conductive plates 7,9 while it is in the first section 101 of the coin guide as while it is in the second section 103 of the coin guide 3. Such a coin will only provide a different effect on the capacitance C when it reaches the third section 105 of the coin guide 3 and is able to overlap the reduced-thickness part 109 of the side wall 2 which comes down lower than the reduced thickness section 107 of the side wall 2 in the second section 103 of the coin guide 3. In the arrangement of FIGS. 17 and 18, the reduced-thickness sections 107,109 of the side wall 2 are present at the bottom of the side wall 2, and extend upwardly by different amounts in the second and third sections 103, 105 of the coin guide 3. In this way, even a small diameter coin will have a different effect on the capacitance C between the conductive plates 7,9 in each of the three sections 101,103,105 of the coin guide 3.

FIG. 19 is a side view of a side wall 2 of another embodiment of the present invention, and FIG. 20 is a top view of the coin guide 3 in the embodiment of FIG. 19.

In the embodiment of FIGS. 19 and 20 the thickness of the side wall 2 is reduced in the second section 103 of the coin guide relative to its thickness in the first section 101 of the coin guide, over the entire height of the side wall 2. In the third section 105 of the coin guide 3, the thickness of the side wall 2 is reduced further, again over the entire height of the side wall 2. Accordingly, the values of the thickness D2 of the side wall and the width D1 of the air gap are different for each of the three sections 101,103,105 of the coin guide 3.

In the embodiments of FIGS. 15 and 16, FIGS. 17 and 18 and FIGS. 19 and 20, the difference between the second section 103 and the third section 105 of the coin guide 3 has involved a change of the same parameter as the difference between the first section 101 and the second section 103 of the coin guide 3. However, this is not essential. FIG. 21 is a side view of a side wall 2 in a further embodiment of the present invention, FIG. 22 is a top view of the coin guide 3 in the embodiment of FIG. 21, and FIG. 23 is an end view of the coin guide 3 in the embodiment of FIG. 21.

In the embodiment of FIGS. 21, 22 and 23 the side wall 2 of the coin guide 3 has a different thickness over its entire height in the second section 103 of the coin guide as compared with the first section 101 of the coin guide. In this respect, this embodiment resembles the embodiment of FIGS. 19 and 20. However, this embodiment resembles the embodiment of FIGS. 15 and 16 in that the thickness of a lower part of the side wall 2 of the coin guide 3 in the third section 105 of the coin guide 3 is the same as the thickness of the side wall 2 in the second section 103 of the coin guide 3. As a modification to the arrangement of FIGS. 15 and 16, in the upper part of the third section 105 of the coin guide 3, the side wall 2 is absent completely rather than being present with a reduced thickness. The conductive plate 7 is also absent completely in the upper part of the third section 105 of the coin guide 3 in this embodiment. Where the conductive plates 7,9 are provided by printing a conductive ink on the side walls 2 of the coin guide 3, it is not practical to provide a part of the conductive plate 7 where there is no side wall 2. However, it would be possible to provide the conductive plate 7 even where there is no side wall 2 in arrangements where the conductive plate 7 is provided by a separate conductive plate bonded to the side wall 2.

The absence of the conductive plate 7 from the upper part of the third section 105 of the coin guide 3 means that the effective area Ac of a coin 1 is different in the third section 105 of the coin guide 3 from in the second section 103 of the coin guide 3. In an arrangement corresponding to the embodiment of FIGS. 21, 22 and 23, but in which the conductive plate 7 extended for the full height of the coin guide 3 in the third section 105, and only the side wall 2 was missing in the upper section, the effective area Ac of the coin 1 would not be different between the second section 103 and the third section 105 of the coin guide 3, but instead the effective values of the width D1 of the air gap and the thickness D2 of the side wall 2 would be different between these sections of the coin guide 3.

FIG. 24 is a side view of a side wall 2 in a another embodiment of the present invention, and FIG. 25 is an end view of the coin guide 3 in the embodiment of FIG. 24.

In the embodiment of FIGS. 24 and 25, the physical dimensions of the side wall 2 are not altered between the sections 101,103,105 of the coin guide 3. Instead, the side wall 2 is made of a different dielectric material in each of the three sections. The values of the relative permittivity of plastics materials suitable for use in the coin guide 3 will typically be between 2 and 6. In the embodiment of FIGS. 14 and 15, the different materials are chosen to have different relative permittivities, so that the value Er will be different in each of the three sections 101,103,105 of the coin guide 3. In this way, the effect of the coin 1 on the overall capacitance C between the conductive plates 7,9 will be different for each of the sections 101,103,105.

The embodiments of FIGS. 12 to 25 provide some examples of the ways in which changes can be made in the effective values of D1,D2,Er and Ac, so that coins which cannot be distinguished on their effect while they are in one section of the coin guide 3 can be distinguished by their effect when they are in another section of the coin guide 3.

A coin validator will normally be set up for use with a particular predetermined coin set. Substantially the same coin validator can be manufactured for use with a variety of coin sets, and the particular coin set for which it is to be used is determined by the difference values stored in the look up table, by which the effect of a coin on the capacitance between the conductive plates 7,9 is translated into a coin recognition or rejection. The width of the air gap D1 in a coin guide 3 must be sufficient to permit the thickest coin of the coin set to pass along the guide 3 without obstruction. Where a validator is made for use with a variety of possible sets of coins, the width of the thickest coin in one coin set may be different from the width of the thickest coin in another coin set. Therefore, the coin guide may have a width D1 of the air gap which is larger than is necessary for use with some of the coin sets.

If the width D1 of the air gap is reduced, the effect of the presence of a coin 1 on the capacitance between the conductive plates 7,9 will tend to be increased, making it easier for the validator to detect the presence of a coin. The increased values in the change of the capacitance C also tends to make it easier to distinguish between the different coins of the coin set. Thus, it is in general desirable to minimise the width of the air gap D1, to the extent that this is possible while still permitting the thickest coin of the coin set to pass down the coin guide 3. The effect of reducing the width of the air gap D1 remains even if the thickness D2 of the side walls are increased by a corresponding amount, because the relative permittivity Er of the material of the side walls 2 is greater than 1 so that the overall capacitance C is increased by filling part of the air gap with the material of the side wall 2.

Where a validator has been made with a relatively wide air gap D1 in the coin guide 3, but it is to be used with a coin set in which the thickest coin is substantially thinner than the width of the air gap D1, the validator can be modified as shown in FIGS. 26 and 27. FIG. 26 is a side view of an insert 111 of dielectric material, which may be attached to the inner side of a side wall 2 of the coin guide 3, as shown in FIG. 27. In this way, part of the width of the air gap D1 is filled with dielectric material. This arrangement allows the manufacturing convenience of making one standard coin guide 3 for a range of validators. The width of the air gap D1 can then be adapted at low cost by attaching an appropriate insert 111 to take into account the thickness of the thickest coin in the coin set with which the validator is to be used.

Additionally, the feature of an insert 111 can be used as a means of providing the difference between the first section 101, second section 103 and third section 105 of the coin guide 3 as discussed with reference to FIGS. 15 to 25. For example, FIG. 28 shows a side view of an insert 111 having a stepped height, so that when it is attached to one of the side walls 2 an arrangement is obtained which is equivalent to the embodiment of FIGS. 15 and 16. FIG. 29 shows a top view of an insert 111 having a stepped thickness, so that when such an insert is attached to a side wall 2 an arrangement is provided corresponding to the embodiment of FIGS. 19 and 20. FIG. 30 shows an insert 111 in which different sections are made of materials having different relative permittivities, so that when such an insert is attached to a side wall 2, an arrangement is provided corresponding to the embodiment of FIGS. 24 and 25. This allows the manufacturing convenience of making standard uniform coin guides 3, and separately manufacturing a range of inserts to define the different sections 101,103,105 of the coin guide 3.

Although it has not been shown in FIGS. 15 to 30, the coin guide 3 will normally be set at a sideways tilt so that the coin always rests against one of the side walls 2 and does not contact the other, as shown in FIG. 2. Where the different sections of the coin guide are defined by differences in the physical dimensions of a side wall 2, and particularly in cases where the thickness of a side wall 2 changes, it is normally preferable for the side wall having the physical variations to be the side wall against which the coin 1 does not rest, so that the variations in the physical dimension of the side wall 2 do not interefere with the smooth rolling of the coin 1 along the coin guide 3.

In a further embodiment of the invention as shown in FIG. 31 and FIG. 32*a* an inductive sensor 71 is situated on the inner wall of the coin guide 3 opposite the wall along which a coin 1 moves, in conjunction with capacitive plates 73 and 75. The inductive sensor 71 is a plate carrying an inductor coil connected in series with the inductance of the oscillator circuit 23 so that as coin 1 moves between the plates 71, 73 and 75 along path P both the capacitance and the inductance of the oscillator circuit 23 are affected and therefore the resonant frequency of the oscillator circuit 23 is changed, as shown in FIG. 32*b*. Provided that the coins 1 are electrically conductive, the composition of the coin has relatively little effect on the capacitance of the conductive plates. However, the inductive sensor 71 will be affected by the magnetic properties of the coin, and accordingly it enables the system to distinguish between a non-magnetic coin and a ferro-magnetic mild steel blank of the same diameter and thickness.

FIG. 33 shows a modification of the oscillator circuit 23 of FIG. 6, for use with the above embodiment, where the coil of the inductive sensor 71 is represented by inductance L1 is connected in series with the inductance L2. The coin path P is shown with dotted arrows moving between the capacitive plates 73 and 75 and past the inductive sensor 71.

The circuit of FIG. 7 can be modified in a similar manner for use with the inductive sensor 71 (which in this case may be a wound coil instead of a plate, in view of the relatively low 6 MHz operating frequency). In this case, the terminals JP2 are not shorted together. Instead the coil of the inductive sensor 71 is connected between the terminals JP2, in series with inductance L1.

The inductive sensor 71 can be provided at the same position along the guide 3 as the conductive plates 73, 75 so that a single composite difference value is obtained for each coin. Alternatively, the inductive sensor 71 may overlap only part of the conductive plates 73, 75 or not overlap them at all, so that each coin produces two distinct difference values.

Since the inductive sensor 71 is used to distinguish between ferro-magnetic and non-magnetic coins, and is not used for detailed size detection, it is not necessary to provide an expensive wound coil or a ferrite core. For the same reason, it does not matter that at the high operating frequencies discussed above for the oscillator circuit 23, the magnetic field of the inductive sensor 71 will typically not penetrate a coin. Under these circumstances, the effect of a coin on the inductive sensor 71 will largely be due to its effect of concentrating or dispersing magnetic flux, not due to eddy currents in the coin, and this effect will be different for retro-magnetic and non-magnetic coins.

FIG. 34 shows an alternative circuit to that in FIG. 3 where the output of the oscillator 77 is fed into a frequency divider 79 via a buffer 81, similarly to the circuit of FIG. 3, but the output of the frequency divider 79 is fed via a co-axial cable 83 to a mixer 85 instead of to the pulse shaper 29 of FIG. 3. In the mixer 85 the signal is mixed with a reference signal of known frequency produced by a reference oscillator 87. The resulting signal has a lowest frequency component which represents the difference between the reference frequency and the detection signal frequency from the frequency divider 79. This mixed frequency signal is passed to a low-pass filter 89 to obtain the frequency difference signal which is passed to a pulse shaper 91, then to a frequency divider 93 and then to a microprocessor 95 where the frequency difference is compared to the range of frequency differences for known valid coins which are stored in memory 97. If the frequency difference matches that of a known valid coin, the microprocessor 95 indicates to the control circuit 99 that the coin is valid and of a particular denomination and if the frequency difference is not matched against that of known valid coin, the microprocessor 95 sends a signal to the control circuit 99 to indicate that the coin 1 is invalid and should be rejected.

The microprocessor 95 determines the difference frequency by counting pulses received from the frequency divider 93 in a preset period. The frequency divider 93 is used to scale the difference frequency so that the number of pulses counted by the microprocessor does not overflow its internal registers.

This circuit may be compensated for drift in the rest frequency of the oscillator 77 by making a corresponding change to the frequency of the reference oscillator 87. This is the equivalent in this embodiment to varying the reference value in Store A 41 in the embodiment of FIGS. 3 and 4.

As discussed above, the frequency divider 79 is not necessary if the oscillator circuit 77 operates at a sufficiently low frequency, such as the 6 MHz proposed for the circuit of FIG. 7. Additionally, the co-axial cable 83 is not needed if the components are housed in a common protective box 13.

As can be seen, the illustrated embodiments provide a coin validator of simple construction, and in which the structure of the validator does not wholly determine which coins can be detected and accepted. Modification of the validator to alter which coins are acceptable can be carried out easily since it will often only be necessary to change the contents of the look-up table.

I claim:

1. Apparatus for determining whether an input coin is acceptable and for distinguishing between a plurality of acceptable coins, comprising:

capacitor means;

guide means to guide an input coin along a coin path past the capacitor means to affect the capacitance of the capacitor means while the coin is in a first portion of the coin path;

oscillator means for providing an oscillating output signal the frequency of which is affected by the capacitance of the capacitor means;

value obtaining means for receiving the oscillating output signal and obtaining a first value representing the frequency of the oscillating output signal while an input coin is in the first portion of the coin path, said value obtaining means comprising counter means for counting the oscillations of the oscillating output signal to obtain a measurement of the frequency thereof;

further means for obtaining a second value representing a parameter of the input coin other than its effect on the capacitance of the capacitor means; and decision means for making a decision on the basis of the first value whether the input coin is acceptable and, if so, which of a plurality of acceptable coins it is, the decision means using said second value to distinguish between different input coins which result in the same first value.

2. Apparatus according to claim 1 in which said further means comprises a coin diameter detector.

3. Apparatus according to claim 2 in which the coin diameter detector comprises an optical sensor.

4. Apparatus according to claim 2 in which the coin diameter detector comprises means for detecting whether the diameter of an input coin is more or less than a threshold diameter.

5. Apparatus according to claim 1 in which said further means comprises an inductor, the inductance of which is affected by the input coin.

6. Apparatus according to claim 5 in which the frequency of the oscillating output signal is affected by the inductance of the inductor, the input coin affects the inductance of the inductor while the coin is in a second portion of the coin path, and the second value represents the frequency of the oscillating output signal while the input coin is in the second portion of the coin path.

7. Apparatus according to claim 6 in which the second value provides a measurement of whether the input coin is ferromagnetic or paramagnetic.

8. Apparatus according to claim 1 comprising compensation means for monitoring the rest frequency of the oscillating output signal in the absence of an input coin and compensating the decision means for changes in the rest frequency over time.

9. Apparatus according to claim 1 in which the oscillator means comprises a capacitance/inductance tuned oscillator.

10. Apparatus for determining whether an input coin is acceptable and for distinguishing between a plurality of acceptable coins, comprising:

capacitor means;

guide means to guide an input coin along a coin path past the capacitor means, thereby to affect the capacitance of the capacitor means;

oscillator means for providing an oscillating output signal the frequency of which is affected by the capacitance of the capacitor means; and decision means for receiving the oscillating output signal and making a decision on the basis of the frequency thereof whether the input coin is acceptable and, if so, which of a plurality of acceptable coins the input coin is, the decision means comprising compensation means for monitoring the rest frequency of the oscillating output signal in the absence of an input coin and compensating the decision means for changes in the rest frequency over time.

11. Apparatus according to claim 10 in which the decision means comprises means for deriving a difference value representing the difference between the frequency of the oscillating output signal when an input coin is present and a reference frequency, and making said decision on the basis of the difference value and a pre-stored correlation of possible difference values and input coin identification data.

12. Apparatus according to claim 11 in which the reference frequency is substantially equal to the rest frequency of the oscillating output signal when no coin is input.

13. Apparatus according to claim 11 in which the compensation means comprises means for updating the reference frequency to take account of changes over time in the rest frequency of the oscillating output signal.

14. Apparatus according to claim 11 in which the decision means comprises means for comparing a value representing the frequency of the oscillating output signal with a pre-stored value representing the reference frequency and deriving the difference value thereby.

15. Apparatus according to claim 14 in which the compensation means comprises updating means for updating the pre-stored value to take account of changes over time in the rest frequency of the oscillating output signal.

16. Apparatus according to claim 15 in which the updating means comprises means for comparing the pre-stored value with a value representing the rest frequency of the oscillating output signal, and updating the pre-stored value in response to the result of the comparison.

17. Apparatus according to claim 10 in which the capacitor means has different coin area/width trade-off groups at different positions along the coin path, a coin area/width trade-off group being a group of possible coin dimensions the members of which have different coin widths and different coin areas but the same effect on the capacitance of the capacitor means when a coin having the coin dimensions is at the position along the coin path.

18. Apparatus according to claim 17 in which the capacitor means comprises a plurality of conductive plates and said different coin area/width trade-off groups are provided by different separations between conductive plates of the capacitor means at different positions along the coin path.

19. Apparatus according to claim 17 in which the capacitor means comprises a plurality of conductive plates, and said conductive plates have different extents or positions in a direction transverse to the coin path at different positions along the coin path, thereby to provide said different coin area/width trade-off groups.

20. Apparatus according to claim 17 in which the capacitor means comprises a plurality of conductive plates and said different coin area/width trade-off groups are provided by different widths of an air gap between the conductive plates at different positions along the coin path.

21. Apparatus according to claim 10 in which the capacitor means comprises a plurality of conductive plates and the coin path passes therebetween.

22. Apparatus according to claim 10 further comprising inductor means, the guide means guiding an input coin past the inductor means and the frequency of the oscillating output signal being affected by the inductance of the inductor means.

23. Apparatus according to claim 10 further comprising further means for distinguishing between input coins on the basis of a physical dimension, the decision means being capable of making the said decision also on the basis of the output of the further means.

24. Apparatus according to claim 23 in which the physical dimension comprises coin diameter.

25. Apparatus according to claim 10 in which the oscillator means comprises a capacitance/inductance tuned oscillator.

26. Apparatus according to claim 17 in which the capacitor means comprises dielectric material and a plurality of conductive plates, and said different coin area/width trade-off groups are provided by different widths of said dielectric material between the conductive plates at different positions along the coin path.

27. Apparatus according to claim 16 in which the updating means comprises means for incrementing or decrementing the pre-stored value in response to the result of the comparison.

28. Apparatus according to claim 15 in which the updating means comprises means for updating the pre-stored value in response to changes in the frequency of the oscillating output signal in the presence of an input coin as well as in the absence of an input coin.

29. Apparatus according to claim 27 in which the updating means comprises means for comparing the pre-stored value with a value representing the frequency of the oscillating output signal in the presence of a coin, and incrementing or decrementing the pre-stored value in response to the result of the comparison.

30. Apparatus for determining whether an input coin is acceptable and for distinguishing between a plurality of acceptable coins, comprising:

capacitor means composing first and second capacitor plates;

guide means to guide an input coin along a coin path between the capacitor plates leaving an air gap between the coin and the first capacitor plate to affect the capacitance of the capacitor means;

determination means for responding to the effect of an input coin on the capacitance of the capacitor means to determine whether the coin is unacceptable or which of a plurality of acceptable coins the input coin is; and a piece of material, separate from the material of the guide means, fixed to the guide means where an input coin passes the capacitor means, narrowing the width of the coin path and the width of said air gap compared with the width of the coin path and the width of said air gap if the piece of material was not present, said piece of material affecting the capacitance of the capacitor means and providing a difference in the effect of an input coin on the capacitor means at different positions along the coin math.

31. Apparatus according to claim 30 in which the piece of material is non-uniform in at least one parameter consisting of: height; thickness; and composition, in the direction along the coin path.

32. Apparatus according to claim 30 in which said determination means comprises:

oscillator means for providing an oscillating output signal the frequency of which is affected by the capacitance of the capacitor means;

counter means for counting the oscillations of the oscillating output signal to obtain a measurement of the frequency; and decision means for using said measurement of the frequency of the oscillating output signal to decide whether the coin is unacceptable or which of a plurality of acceptable coins the input coin is.

33. Apparatus for determining whether an input coin is acceptable and for distinguishing between a plurality of acceptable coins, comprising:

capacitor means;

inductor means;

guide means to guide an input coin along a coin path past the capacitor means thereby to affect the capacitance of the capacitor means and past the inductor means thereby to affect the inductance of the inductor means depending on the magnetic properties of the input coin;

oscillator means for providing an oscillating output signal the frequency of which is affected by the capacitance of the capacitor means and by the inductance of the inductor means; and decision means for receiving the oscillating output signal and making a decision on the basis of the frequency thereof whether the input coin is acceptable and, if so, which of a plurality of acceptable coins the input coin is whereby the effect of the inductance of the inductor means on the frequency of the oscillating output signal enables the decision means to be responsive to the magnetic properties of the input coin.

34. Apparatus according to claim 33 in which the inductor means and the capacitor means are present at a common position along the coin path, and the decision means comprises means for making the decision on the basis of the frequency of the oscillating output signal at a time when both the capacitance of the capacitor means and the inductance of the inductor means are affected by an input coin.

35. Apparatus according to claim 33 in which the inductor means and the capacitor means are present at first and second positions, respectively, with no overlap or only a partial overlap, and the decision means comprises means for making the decision on the basis of: (i) the frequency of the oscillating output signal at a time when only one of the capacitance of the capacitor means and the inductance of the inductor means is affected by an input coin; and (ii) the frequency of the oscillating output signal at a time when only the other of the capacitance of the capacitor means and the inductance of the inductor means is affected by the input coin or when both of them are affected by the input coin.

36. Apparatus for determining whether an input coin is acceptable and for distinguishing between a plurality of acceptable coins, comprising:

capacitor means;

guide means to guide an input coin along a coin path past the capacitor means to affect the capacitance of the capacitor means;

oscillator means for providing an oscillating output signal the frequency of which is affected by the capacitance of the capacitor means; and decision means for receiving the oscillating output signal, counting the oscillations of the oscillating output signal to obtain a measurement of the frequency thereof, and making a decision on the basis of said measurement of the frequency of said oscillations whether the input coin is acceptable and, if so, which of a plurality of acceptable coins the input coin is.

37. A method of determining whether an input coin is acceptable and for distinguishing between a plurality of acceptable coins, comprising: guiding an input coin along a coin path past capacitor means so as to affect the capacitance thereof while at a first position along the coin path; generating an oscillating output signal the frequency of which is affected by the capacitance of the capacitor means, counting the oscillations of the oscillating output signal to obtain a measurement of the frequency thereof; and rejecting the input coin or deciding which of a plurality of acceptable coins the input coin is on the basis of (i) said measurement of the frequency of the oscillating output signals while the input coin is at a first position along the coin path and (ii) a value representing a parameter of the input coin other than its effect on the capacitance of the capacitor means at the first position along the coin path.

38. A method according to claim 37 in which said value is the frequency of the oscillating output signal when the coin is at a second position along the coin path at which the coin also affects the capacitance of the capacitor means, but one or more physical parameters of the capacitor means, which determine the extent to which the coin affects the capacitance of the capacitor means, is different at the second position from the first position.

39. A method according to claim 37 in which said value represents a parameter of the input coin other than its effect on the capacitance of the capacitor means.

40. A method of determining whether an input coin is acceptable and for distinguishing between a plurality of acceptable coins, comprising: guiding an input coin past capacitor means so as to affect the capacitance thereof; generating an oscillating output signal the frequency of which is affected by the capacitance of the capacitor means; and rejecting the input coin or deciding which of a plurality of acceptable coins the input coin is on the basis of the frequency of the oscillating output signal, the method further comprising monitoring the rest frequency of the oscillating output signal in the absence of a coin so as to compensate the rejecting or deciding step for changes in the rest frequency over time.

41. A method of determining whether an input coin is acceptable and for distinguishing between a plurality of acceptable coins, comprising: guiding an input coin past capacitor means so as to affect the capacitance thereof and past inductor means so as to affect the inductance thereof depending on the input coin's magnetic properties; generating an oscillating output signal the frequency of which is affected by the capacitance of the capacitor means and by the inductance of the inductor means; and rejecting the input coin or deciding which of a plurality of acceptable coins the input coin is on the basis of the frequency of the oscillating output signal, whereby the magnetic properties of the coin are taken into account in rejecting the input coin or deciding which of a plurality of acceptable coins the input coin is.

42. A method of determining whether an input coin is acceptable and for distinguishing between a plurality of acceptable coins, comprising: guiding an input coin past capacitor means so as to affect the capacitance thereof; generating an oscillating output signal the frequency of which is affected by the capacitance of the capacitor means counting the oscillations of the oscillating output signal to obtain a measurement of the frequency thereof; and rejecting the input coin or deciding which of a plurality of acceptable coins the input coin is on the basis of said measurement of the frequency of the oscillating output signal.

43. Apparatus for determining whether an input coin is acceptable and for distinguishing between a plurality of acceptable coins, comprising:

capacitor means;

guide means to guide an input coin along a coin path past the capacitor means to affect the capacitance of the capacitor means while the coin is in a first portion of the coin path and while the coin is in a second portion of the coin path;

oscillator means for providing an oscillating output signal the frequency of which is affected by the capacitance of the capacitor means;

value obtaining means for receiving the oscillating output signal and obtaining first and second values respectively representing the frequency of the oscillating output signal while an input coin is in the first and second portions of the coin path, the value obtaining means comprising counter means for counting the oscillations of the oscillating output signal to obtain measurements of the frequency thereof; and decision means for making a decision on the basis of the first value whether the input coin is acceptable and, if so, which of a plurality of acceptable coins it is;

one of more of the physical parameters of the capacitor means, which determine the extent of the effect of an input coin on the capacitance of the capacitor means, being different at the second portion of the coin path from the first portion of the coin path, and the decision means using said second value to distinguish between different input coins which result in the same first value.

44. Apparatus according to claim 43 in which one or more of said physical parameters varies gradually from the first portion to the second portion of the coin path.

45. Apparatus according to claim 43 in which one or more of said physical parameters varies substantially as a step function from the first portion to the second portion of the coin path.

46. Apparatus according to claim 43 in which said capacitor means comprises a capacitor plate and said guide means comprises a floor, and said one or more physical parameters comprises the height of an edge of said capacitor plate of the capacitor means above said floor of the guide means, which affects the amount of overlap between the area of the input coin and the capacitor plate.

47. Apparatus according to claim 43 in which said capacitor means comprises a plurality of capacitor plates and said one or more physical parameters comprises the spacing apart of a pair of said capacitor plates of the capacitor means.

48. Apparatus according to claim 43 in which said capacitor means comprises dielectric material and a plurality of capacitor plates, and said one or more physical parameters comprises the effective thickness of said dielectric material between a pair of said capacitor plates of the capacitor means.

49. Apparatus according to claim 43 in which said capacitor means comprises dielectric material and a plurality of capacitor plates, and said one or more physical parameters comprises the effective dielectric constant or relative permittivity of said dielectric material between a pair of said capacitor plates of the capacitor means.

50. Apparatus according to claim 43 in which said capacitor means comprises a plurality of capacitor plates, and said one or more physical parameters comprises the effective width of an air gap through which the input coin passes between a pair of said capacitor plates of the capacitor means.

51. Apparatus according to claim 43 in which said guide means comprises a floor and the value of one of said physical parameters varies as a function of height above the floor of the guide means, at one of said portions of the coin path.

52. Apparatus according to claim 51 in which the value of one of said physical parameters is the same for both said portions of the guide means over a first height range above the floor of the guide means but is different for the first and second portions over a second height range above the floor of the guide means, so that the first and second portions have different effective values for the physical parameter concerned.

53. Apparatus according to claim 43 in which the guide means comprises a wall and a member fixed thereto, and said member provides a difference in one or more said physical parameters between the first portion and the second portion of the coin path.

54. Apparatus according to claim 43 comprising compensation means for monitoring the rest frequency of the oscillating output signal in the absence of an input coin and compensating the decision means for changes in the rest frequency over time.

* * * * *

UNITED STATES PATENT AND TRADEMARK OFFICE

CERTIFICATE OF CORRECTION

PATENT NO. : 5,687,829

DATED : Nov. 18, 1997

INVENTOR(S) : Churchman

It is certified that error appears in the above-identified patent and that said Letters Patent is hereby corrected as shown below:

Column 2, line 31, "con.usable" should read --confusable--.

Column 9, line 14, "Lo" should read --to--.

Column 13, line 41, "disninguishable." should read --distinguishable.--

Column 16, line 19, "coin 1'" should read --coin 1"--.

Column 18, line 13, "side wall in the" should read --side wall 2 in the

Column 21, line 36, "for retro-magnetic" should read --for ferro-magnetic--.

Column 25, lines 5 and 6, "input coin on the capacitor means at different positions along the coin math." should read --input coin on the capacitance of the capacitor means at different positions along the coin path--.

Signed and Sealed this

Twenty-fourth Day of November, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,687,829

DATED : November 19, 1997

INVENTOR(S) : Churchman

It is certified that error appears in the above-identified patent and that said Letters Patent is hereby corrected as shown below:

On the cover page, at [63], after "abandoned." insert

--which is a 371 of PCT/GB93/02119 Filed October 13, 1993--.

Column 1, line 2, after "abandoned" insert --which is a 371 of PCT/GB93/02119 filed October 13, 1993--.

Signed and Sealed this

Fourth Day of May, 1999

*Attest:*

*Attesting Officer*

Q. TODD DICKINSON

*Acting Commissioner of Patents and Trademarks*